US007978992B2

(12) United States Patent
Okunishi et al.

(10) Patent No.: US 7,978,992 B2
(45) Date of Patent: Jul. 12, 2011

(54) IMAGE FORMING APPARATUS EXECUTING STABILIZATION PROCESS AT PROPER FREQUENCY

(75) Inventors: Kazuo Okunishi, Okazaki (JP); Atsushi Kawai, Toyokawa (JP); Yoshihiko Yoshizaki, Toyokawa (JP); Kohei Hayashi, Okazaki (JP); Hideaki Komiyama, Toyokawa (JP); Yasufumi Naitou, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 306 days.

(21) Appl. No.: 12/414,059

(22) Filed: Mar. 30, 2009

(65) Prior Publication Data

US 2009/0310990 A1 Dec. 17, 2009

(30) Foreign Application Priority Data

Jun. 13, 2008 (JP) ..... 2008-155518

(51) Int. Cl.
*G03G 15/00* (2006.01)

(52) U.S. Cl. ..... 399/44; 399/24; 399/43; 399/81

(58) Field of Classification Search ..... 399/43, 399/44, 81, 31, 26, 27, 29, 32, 24
See application file for complete search history.

(56) References Cited

U.S. PATENT DOCUMENTS

| | | | | |
|---|---|---|---|---|
| 5,966,557 | A | 10/1999 | Wada | |
| 7,409,169 | B2 * | 8/2008 | Matsuda | 399/27 |
| 7,801,453 | B2 * | 9/2010 | Golding et al. | 399/27 |

FOREIGN PATENT DOCUMENTS

| | | |
|---|---|---|
| JP | 5-6064 | 1/1993 |
| JP | 11-160921 | 6/1999 |
| JP | 2004-45605 | 2/2004 |
| JP | 2006-234868 | 9/2006 |
| JP | 2007-072246 | 3/2007 |

OTHER PUBLICATIONS

Japanese Decision to Grant Patent mailed May 25, 2010, directed to corresponding Japanese Patent Application No. 2008-155518; 6 pages.

* cited by examiner

*Primary Examiner* — Susan S Lee
(74) *Attorney, Agent, or Firm* — Morrison & Foerster LLP

(57) ABSTRACT

In an MFP, when a count of printed sheets of paper exceeds a predetermined count, a controller reads, from internal counters, a frequency of a stabilization process executed in return, a frequency of a stabilization process executed automatically in printing, a frequency of a stabilization process executed manually based on a user's instruction, and a frequency of return, respectively. When the frequency of the stabilization process executed automatically is small while the frequency of the stabilization process executed manually is large, the controller raises a frequency level of execution of the stabilization process. When the frequency of the stabilization process executed manually is small, the controller lowers the frequency level of execution of the stabilization process.

11 Claims, 24 Drawing Sheets

FIG.3

| |
|---|
| CTPRINT1 |
| CTPRINT2 |
| CTSTABI1 |
| CTSTABI2 |
| CTSTABI3 |
| CTWUP |
| TIMECOUNTER |
| T0 |
| T |
| ⊿T1 |
| ⊿T2 |
| CT2 |
| L1 |
| L2 |

FIG.22

| CONDITION NO. | CONDITIONS | | | DETAILS OF CHANGE |
|---|---|---|---|---|
| | EXECUTION FREQUENCY OF THIRD STABILIZATION PROCESS | FREQUENCY OF RETURN | EXECUTION FREQUENCY OF FIRST STABILIZATION PROCESS | |
| 1 | LARGE | LARGE | SMALL | INCREASE EXECUTION FREQUENCY OF FIRST STABILIZATION PROCESS |
| 2 | LARGE | LARGE | LARGE | INCREASE EXECUTION FREQUENCY OF SECOND STABILIZATION PROCESS |
| 3 | LARGE | SMALL | — | INCREASE EXECUTION FREQUENCY OF SECOND STABILIZATION PROCESS |
| 4 | SMALL | — | LARGE | DECREASE EXECUTION FREQUENCY OF FIRST STABILIZATION PROCESS |
| 5 | SMALL | — | SMALL | DECREASE EXECUTION FREQUENCY OF SECOND STABILIZATION PROCESS |

IMAGE FORMING APPARATUS EXECUTING STABILIZATION PROCESS AT PROPER FREQUENCY

This application is based on Japanese Patent Application No. 2008-155518 filed with the Japan Patent Office on Jun. 13, 2008, the entire content of which is hereby incorporated by reference.

BACKGROUND OF THE INVENTION

1. Field of the Invention

The present invention relates to image forming apparatuses, in particular, an image forming apparatus that executes an image stabilization process.

2. Description of the Related Art

Conventionally, an image forming apparatus such as a printer, a copying machine, or an MFP (Multi Function Peripheral) that functions as a printer, a copying machine and the like executes an image stabilization process in order to offer a stable image while suppressing an influence exerted on image quality due to gradual changes in a photoconductor and a developer, changes in environment such as temperature and humidity, and the like.

FIG. 24 is a flowchart showing a flow of a typical image stabilization process. With reference to FIG. 24, specifically, the stabilization process involves a sensor light amount adjusting step (step S10), a maximum density adjusting step (Dmax adjustment) (step S20), a laser light amount adjusting step (step S30), a resist correcting step (step S40) and a tone correcting step (step S50). Hereinafter, brief description will be given of each step.

(1) Sensor (IDC Sensor: Image Density Control Sensor) Light Amount Adjusting Step The sensor light amount adjusting step refers to a step of adjusting an IDC sensor for detecting an amount of toner attached onto a transfer belt, and this amount corresponds to a density of an image transferred onto a sheet of paper. The IDC sensor is a reflection-type photosensor that detects an intensity of reflected light, and the intensity varies in accordance with an amount of toner attached onto a transfer belt. In the sensor light amount adjusting step, an amount of light emitted from an LED (Light Emitting Diode) serving as a light source is changed such that an output from the IDC sensor based on light reflected from a surface of the transfer belt, where no toner is attached, has a value which falls within a predetermined range. Herein, the surface of the transfer belt, where no toner is attached, is referred to as a "naked surface" or a "bare surface". In the sensor light amount adjusting step, specifically, the output from the IDC sensor has a value of 4.3 V in the case of the "bare surface". In a case where the output value decreases as the amount of attached toner increases, the light amount is adjusted such that the output from the IDC sensor has a value which falls within a range of 4.3 V±0.2 V defined as a "predetermined range".

(2) Maximum Density Adjusting (Dmax Adjusting) Step

In the maximum density adjusting step, control is referred to as control of a maximum amount of attached toner. In order to reproduce multilevel tones, an image forming apparatus changes an "amount of light" from a laser diode (LD) serving as an exposure source and a "density of dots" in image formation. In the maximum density adjusting step, a density of an image is adjusted so as to have a predetermined value in a state that each of the "light amount" and the "dot density" is set at maximum. In the maximum density adjusting step, an amount of toner attached onto the transfer belt, which corresponds to a density of the toner on the transfer belt, is detected in correspondence with image data of a so-called solid image which is reproduced in a state that the light amount is at maximum and the dot density is 100%. Then, image formation conditions such as charging voltage and developing bias are fixed such that the amount of attached toner has a predetermined value.

(3) Laser Light Amount Adjusting Step

The laser light amount adjusting step refers to a step of adjusting an amount of light emitted from the LD to adjust a density per dot. In the laser light amount adjusting step, specifically, the amount of light from the LD is adjusted based on a detected average value of density of image data having a certain dot ratio.

(4) Resist Correcting Step

The resist correcting step refers to a step of detecting and correcting color misregistration due to relative positions of four image forming parts. In the resist correcting step, specifically, a "pattern for detecting a main-scanning misregistration amount" and a "pattern for detecting a sub-scanning misregistration amount" are printed on the transfer belt, and an amount of misregistration of each color is detected from a pattern image scanned by the IDC sensor. Thus, the color misregistration is corrected.

(5) Tone Correcting Step

The image forming apparatus sets an amount of light from the LD and a density of the dots (ON/OFF ratio) in correspondence with a density of image data to be outputted onto a sheet of paper (for example, a density of image data represented by 0 to 255) to output the image data onto the sheet of paper. Therefore, the image forming apparatus stores a relation between the input image data and the output LD light amount or dot density in a form of a table (referred to as a γ table). At the time when the image data is outputted onto the sheet of paper, an LD light amount and a dot density are selected based on the γ table, so that a tone is reproduced. In the tone correcting step, the γ table is corrected such that input image data and a tone characteristic of a printed image establish a predetermined linear relation. In the tone correcting step, a predetermined gradation image is transferred onto the transfer belt, and the IDC sensor reads a density of the gradation image. Thus, the γ table is corrected.

In general, the stabilization process described above is executed occasionally in a warm-up process after turn-on, before execution of the warm-up process, after execution of the warm-up process, upon execution of a printing process, after execution of the printing process, or in such a manner that the printing process under execution is interrupted. That is, the stabilization process is executed when the image forming apparatus intends to execute the printing process to optimize a printing status of the image forming apparatus. Alternatively, change in status based on the printing process is corrected to optimize the printing status of the image forming apparatus. Moreover, when the image forming apparatus returns from a power-saving mode such as a sleep mode, the stabilization process is executed occasionally as in the case of the timing of turn-on.

The stabilization process causes consumption of consumables such as toner, and a waiting time for the printing process. Consequently, it is not appropriate to execute the stabilization process at frequency which is higher than required. However, as an execution frequency of the stabilization process increases, an image to be obtained is improved in image quality. Therefore, various modifications have been made to conditions for and timing of execution of the stabilization process. For example, Japanese Laid-Open Patent Publication No. 11-160921 (hereinafter, referred to as Document 1) discloses the following technique. That is, when processing for forming an image is interrupted due to a trouble such as jamming, determination is made whether to execute a stabilization process in an operation for returning from the interruption. Specifically, Document 1 discloses the technique of determining whether to execute the stabilization process, based on determination conditions including an interruption time and change in environment during the interruption. This technique prevents the stabilization process from being executed more than necessary at the time when the image formation process is interrupted in a short time due to jamming or the like.

Moreover, Japanese Laid-Open Patent Publication No. 2007-072246 (hereinafter, referred to as Document 2) discloses the following technique. That is, in an image forming apparatus that executes a stabilization process at a predetermined time, a stabilization process executing time is determined in accordance with a past count of actually printed sheets of paper kept for each time. This technique prevents a collision of the stabilization process and the printing process, which offers improved convenience to a user.

Further, Japanese Laid-Open Patent Publication No. 2006-234868 (hereinafter, referred to as Document 3) discloses a technique of changing a timing of performing color misregistration correction in accordance with a deviation amount obtained in preceding color misregistration correction. This technique allows execution of a stabilization process at minimum frequency for achieving target quality about the color misregistration.

However, the technique disclosed in Document 1 has the following problem. That is, when a range defined as the interruption is widened so as to cover a power saving mode such as a sleep mode and a power-off state, a threshold value for determining whether to execute the stabilization process can not be set with ease. For example, when a threshold value is set such that the stabilization process is not executed in a case of a long-term interruption, it is possible to suppress the consumption of the consumables and the waiting time, but it is impossible to accomplish an intended object, that is, offering of stable image quality. On the other hand, when the threshold value is set such that the stabilization process is executed even in a case of a short-term interruption, it is possible to offer the stable image quality. However, the execution frequency of the stabilization process increases disadvantageously. As a result, it is impossible to accomplish an object to suppress execution of the unnecessary stabilization process, resulting in consumption of consumables and a waiting time. Further, a requirement for image quality varies for each user.

Moreover, the technique disclosed in Document 2 has the following problem. That is, this technique is not directed to decrease the execution frequency of the stabilization process and, consequently, fails to suppress consumption of consumables. In addition, there is a possibility that the stabilization process is executed in a time zone where the image forming apparatus is not activated so much, but is not executed in a time zone where the image forming apparatus is activated frequently. As a result, there is a possibility that the image forming apparatus fails to offer stable image quality properly.

Further, the technique disclosed in Document 3 has the following problem. That is, if the target quality about the color misregistration does not reach a level required by a user, this technique fails to offer satisfying image quality to the user.

According to the conventional techniques, as described above, it is possible to decrease the execution frequency of the stabilization process. However, it is impossible to offer the satisfying image quality to the user if the execution frequency of the stabilization process is decreased excessively. In actual, consequently, the execution frequency of the stabilization process is set to be large in view of the image quality. As a result, even in a case of adopting the technique capable of decreasing the execution frequency of the stabilization process, advantages of this technique can not be obtained satisfactorily.

SUMMARY OF THE INVENTION

The present invention has been devised in view of the problems described above, and an object thereof is to provide an image forming apparatus capable of optimizing an execution frequency of a stabilization process while offering satisfying image quality to a user.

In order to accomplish this object, according to one aspect of the present invention, an image forming apparatus includes an image forming part for forming an image on a printing medium based on image data, and a stabilization processing part for executing a stabilization process for stabilizing image formation carried out by the image forming part. Herein, the stabilization process includes a first stabilization process and a second stabilization process. The image forming apparatus also includes an instruction part for accepting, from a user, an instruction to execute the stabilization process, a controller for controlling the stabilization process, a first counter for counting an execution frequency of the second stabilization process, and a setting part for setting a frequency level of execution of the first stabilization process. The controller controls the stabilization processing part and the setting part to make first determination whether to execute the stabilization process and execute the first stabilization process at a timing based on the first determination, to execute the second stabilization process at a timing based on the instruction accepted by the instruction part, and to change the frequency level of execution of the first stabilization process, based on the execution frequency of the second stabilization process.

The image forming apparatus adjusts the frequency level of the image stabilization process executed automatically, based on the frequency of the image stabilization process executed in accordance with the instruction issued by the user through an operating panel or the like. Therefore, the image forming apparatus can optimize the execution frequency of the stabilization process while offering the satisfying image quality to the user.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3 shows a specific example of a variable stored in a memory device of the MFP according to the embodiment.

FIG. 22 shows specific conditions for changing the frequency level of execution of the stabilization process.

DESCRIPTION OF THE PREFERRED EMBODIMENTS

With reference to the drawings, hereinafter, description will be given of preferred embodiments of the present invention. In the following description, components or constituent elements which are identical with one another are denoted by a single reference symbol and are equal in designation and function to one another.

An MFP 1 according to one embodiment of the present invention is of a tandem type for color printing. It is to be noted that an image forming apparatus according to the present invention is not limited to the tandem-type MFP for color printing. For example, the image forming apparatus according to the present invention may be an MFP for monochromatic printing. Further, the image forming apparatus according to the present invention is not limited to the MFP. For example, the image forming apparatus according to the present invention may be a printer or a copying machine.

Figure 1:
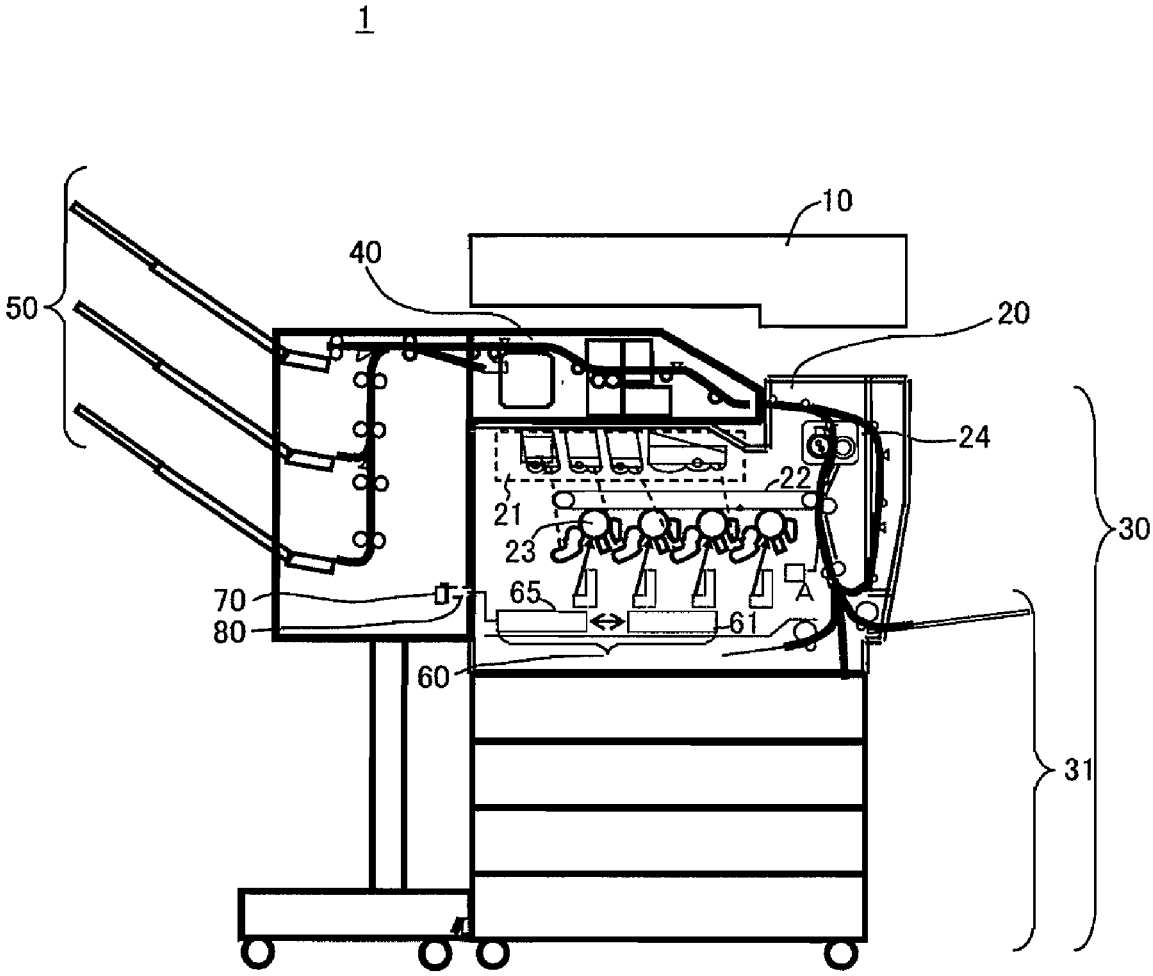
FIG. 1 is a schematic sectional view showing a general configuration of an MFP (Multi Function Peripheral) which is an image forming apparatus according to one embodiment of the present invention.

With reference to FIG. 1, MFP 1 includes a scanner device 10, an image forming part 20, a feeder part 30 that feeds a sheet of paper which is one example of a printing medium, a post-processing device 40, a sheet discharge device 50, a controller 60, an external device interface (hereinafter, abbreviated as IF) 70 that establishes communications with an external device such as a computer (not shown), and a facsimile (hereinafter, abbreviated as FAX) line IF 80 that is connected to a line for FAX communications. Moreover, an operating panel (not shown) is provided at a front side of MFP 1. This operating panel offers various kinds of information to a user, and displays operating buttons for accepting manipulations from the user.

Scanner device 10 includes a scanner that is driven by a scanner motor to move along a document and scans the entire document. The document placed on a document table is irradiated with light by an exposure lamp (not shown) and then is scanned by the scanner. The light reflected from a surface of the document is converted into color data for red, color data for green and color data for blue (analog signals) by a CCD (Charge Coupled Device) of the scanner. The CCD outputs the color data to a scanner controller (not shown). Herein, the color data outputted from the CCD to the scanner controller is referred to as image data. Upon reception of the image data from the CCD, the scanner controller carries out predetermined image processing on the image data, and then outputs digital signals to image forming part 20. Herein, the digital signals outputted from the scanner controller are image color data C for cyan, image color data M for magenta, image color data Y for yellow and image color data K for black.

Controller 60 includes an engine controller 61 and a printer controller 65. Engine controller 61 and printer controller 65 are connected to each other through a line for serial communications and an image bus. Controller 60 controls MFP 1 collectively. Details of controller 60 will be described later.

Image forming part 20 includes a printing control part 21, an intermediate transfer belt 22, a photosensitive drum 23C for cyan, a photosensitive drum 23M for magenta, a photosensitive drum 23Y for yellow, a photosensitive drum 23K for black and a fixing part 24. Herein, photosensitive drums 23C, 23M, 23Y and 23K are representatively referred to as photosensitive drum 23 in some instances.

Photosensitive drum 23 has a surface which is electrically and uniformly charged. Printing control part 21 receives image color data C, image color data M, image color data Y and image color data K, and outputs a laser beam based on image color data C, a laser beam based on image color data M, a laser beam based on image color data Y and a laser beam based on image color data K to photosensitive drum 23C for cyan, photosensitive drum 23M for magenta, photosensitive drum 23Y for yellow and photosensitive drum 23K for black, respectively, in accordance with control signals from engine controller 61. Thus, the surface of the photosensitive drum 23 is exposed, so that a latent image is formed on photosensitive drum 23. Then, when toner is supplied to photosensitive drum 23, a toner image of each color is developed. The toner image developed on the surface of photosensitive drum 23 is transferred to intermediate transfer belt 22.

Feeder part 30 includes a cassette 31 that holds sheets of paper, and a transport path 32 that transports a sheet of paper from cassette 31 to post-processing device 40 via intermediate transfer belt 22 and fixing part 24. Herein, a plurality rollers are provided along transport path 32. The plurality of rollers rotate in accordance with control signals from engine controller 61 to move the sheet of paper on transport path 32. When the sheet of paper is transported to intermediate transfer belt 22, the toner image on intermediate transfer belt 22 is transferred to the sheet of paper. Then, the sheet of paper is transported to fixing part 24 with the toner image being transferred thereto. Herein, the toner image is thermally fused and fixed by fixing part 24.

Post-processing device 40 includes a punch unit 41 that punches a hole in the printed sheet of paper, a folding unit 42 that performs folding on the sheet of paper, and a stapler 43 that performs stapling on the sheet of paper. The printed sheet of paper is subjected to the post-processing described above, in accordance with controls signals from engine controller 61.

Sheet discharge device 50 includes a plurality of sheet discharge trays, and a mechanism that sorts the sheets of paper transported from post-processing device 40 and then discharges the sheet of paper to the corresponding sheet discharge tray in accordance with control signals from engine controller 61.

Figure 2:
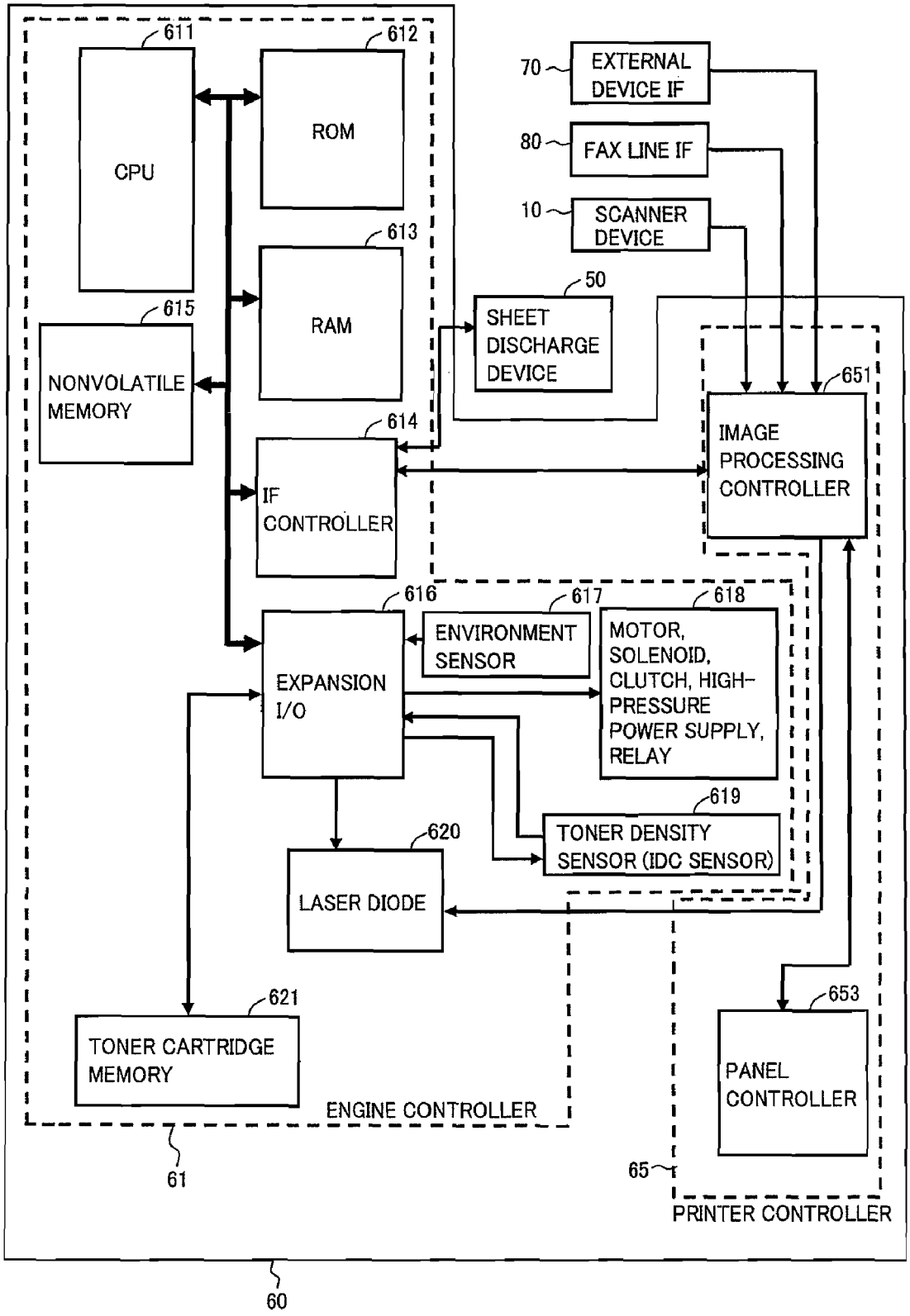
FIG. 2 is a block diagram showing a control configuration of the MFP according to the embodiment.

FIG. 2 principally shows a configuration of engine controller 61 and a configuration of printer controller 65. With reference to FIG. 2, engine controller 61 includes a CPU (Central Processing Unit) 611, a ROM (Read Only Memory) 612, a RAM (Random Access Memory) 613, an IF controller 614, a nonvolatile memory 615, an expansion input/output (hereinafter, abbreviated as I/O) 616, an environment sensor 617 that detects environment conditions, such as a temperature sensor or a humidity sensor, a mechanism 618 that actuates components such as a motor, a solenoid, a clutch, a high-voltage power supply and a relay required for executing an image formation process and an image stabilization process, a toner density sensor (or an IDC (Image Density Control) sensor) 619 that detects a density of a toner image on intermediate transfer belt 22, a laser diode 620 that exposes photosensitive drum 23, and a toner cartridge memory 621 that stores information about a toner cartridge (not shown) for holding photosensitive drum 23. Printer controller 65 includes an image processing controller 651 and a panel controller 653.

Image processing controller 651 is connected to external device IF 70 and FAX line IF 80 to receive a printing instruction and image data. Further, image processing controller 651 is connected to panel controller 653 and scanner device 10 to receive, from panel controller 653, an operating signal inputted to panel controller 653 through the operating panel (not shown). Herein, image processing controller 651 also receives, from scanner device 10, image data obtained by a scan in scanner device 10 in accordance with the received operating signal. In addition, image processing controller 651 receives, from panel controller 653, an operating signal inputted to panel controller 653 through the operating panel (not shown) to carry out designated image processing on the received image data in accordance with the received operating signal. The image data subjected to the image processing is correlated with a printing instruction as data management information, and is inputted to IF controller 614 of engine controller 61 through the image bus. Then, the image data is stored together with the management information in RAM 613 serving as an image memory. Alternatively, the image data may be transferred to and stored in another memory device such as an HDD (Hard Disk Drive) in succession, depending on an amount of the data.

CPU 611 of engine controller 61 reads a program from ROM 612 and executes the program to control a drive configuration of MFP 1. Specifically, nonvolatile memory 615 stores a threshold value used for determining whether to execute a stabilization process. Details of this threshold value will be described later. In order to determine whether to execute the stabilization process, CPU 611 uses sensor signals obtained from environment sensor 617 and toner density sensor 619, information about the toner cartridge, which is stored in toner cartridge memory 612, the threshold value, and the like. In accordance with a result of the determination, then, CPU 611 outputs a light emission control signal to laser diode 620. In addition, CPU 611 outputs a control signal to mechanism 618 for actuating the components such as the motor required for executing the stabilization process. CPU 611 actuates these components under the control to execute the stabilization process.

Figure 24:
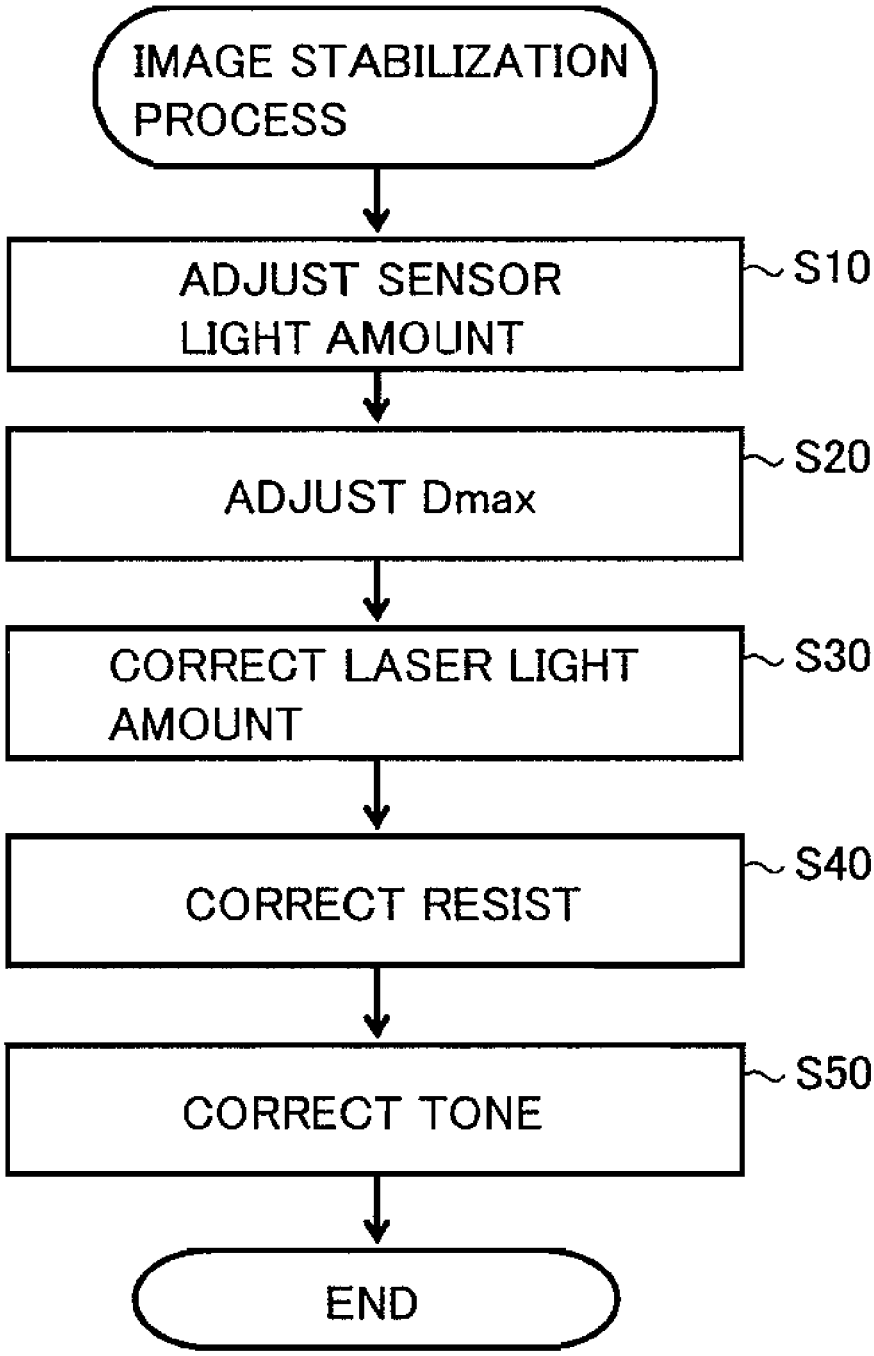
FIG.24 PRIOR ART
FIG. 24 is a flowchart showing a specific example of a flow of a conventional stabilization process.

Engine controller 61 of MFP 1 determines whether to execute the stabilization process at a predetermined timing, and executes the stabilization process in accordance with a result of the determination. Details of the stabilization process are not limited to details of a specific process. For example, the details of the stabilization process are similar to those of the process shown in FIG. 24. Examples of the predetermined timing include a timing related to a warm-up process which is executed when MFP 1 is turned on or returns from a sleep state, and a timing at which the stabilization process is executed during activation of MFP 1. Further, examples of the stabilization process executed during the activation include a process executed automatically based on determination that the stabilization process is executed in the printing process, and a process executed when the user issues an instruction through the operating panel or the like. Specifically, the timing related to the warm-up process refers to a timing after execution of the warm-up process. In the following, the timing related to the warm-up process is described as the timing after execution of the warm-up process. However, the timing related to the warm-up process may be a timing before execution of the warm-up process or a timing during execution of the warm-up process. That is, the timing related to the warm-up process involves all the timings described above. In the following description, the stabilization process executed after execution of the warm-up process is referred to as a "first stabilization process". Moreover, the stabilization process executed automatically based on the determination that the stabilization process must be executed during the printing process is referred to as a "second stabilization process". Further, the stabilization process executed based on the user's instruction during the activation is referred to as a "third stabilization process". MFP 1 adjusts a level of execution frequency (hereinafter referred to as a "frequency level") set for each of the first stabilization process and the second stabilization process, based on an execution frequency of the third stabilization process. ROM 612 and nonvolatile memory 615 store variables such as counters and threshold values each used for adjusting the frequency level. In the following description, it is assumed that these variables are stored in nonvolatile memory 615. However, some of variables which are not changed by processing and the like (to be described later) may be stored in ROM 612.

FIG. 3 shows a specific example of the variable stored in the memory device such as ROM 612 or nonvolatile memory 615 of MFP 1. With reference to FIG. 3, examples of the variable stored in the memory device of MFP 1 include a counter CTPRINT1, a counter CTPRINT2, a counter CTSTABI1, a counter CTSTABI2, a counter CTSTABI3, a counter CTWUP, a timer TIMECOUNTER, a value T0, a value T, a threshold value ΔT1, a threshold value ΔT2, a threshold value CT2, a level L1 and a level L2.

Counter CTPRINT1 is used for keeping a count of printed sheets of paper in order to count a printing frequency. Specifically, counter CTPRINT1 is used for keeping a count of printed sheets of paper since processing for changing the frequency level of execution of the stabilization process is carried out. A value of counter CTPRINT1 is used in processing for determining whether to change the frequency level of execution of the stabilization process. CPU 611 increments a predetermined value each time the printing process is executed to keep the count of printed sheets of paper. The value of counter CTPRINT1 is reset when it is determined that the frequency level of execution of the stabilization process is changed.

Counter CTPRINT2 is also used for keeping a count of printed sheets of paper. Specifically, counter CTPRINT2 is used for keeping a count of printed sheets of paper since the preceding stabilization process is executed. A value of counter CTPRINT2 is used for determining that the stabilization process is executed in the printing process in order to execute the stabilization process each time the count of printed sheets of paper reaches a predetermined count. CPU 611 increments a predetermined value each time the printing process is executed to keep the count of printed sheets of paper. The value of counter CTPRINT2 is reset when the stabilization process is executed.

Counter CTSTABI1 is used for counting an execution frequency of the first stabilization process since the processing for changing the frequency level of execution of the preceding stabilization process is carried out. Counter CTSTABI2 is used for counting an execution frequency of the second stabilization process since the processing for changing the frequency level of execution of the preceding stabilization process is carried out. Counter CTSTABI3 is used for counting an execution frequency of the third stabilization process since the processing for changing the frequency level of execution of the preceding stabilization process is carried out.

Counter CTWUP is used for counting an activation frequency of MFP 1 since the processing for changing the frequency level of execution of the preceding stabilization process is carried out. Specifically, counter CTWUP is used for counting a frequency of activation by turn-on or a frequency of return from a sleep mode. In other words, counter CTWUP is used for counting a frequency of the warm-up process executed after the activation or the return.

Timer TIMECOUNTER counts an activation period of time of MFP 1 since the processing for changing the frequency level of execution of the preceding stabilization process is carried out. Specifically, timer TIMECOUNTER counts a period of time during which MFP 1 can be operated, for example, MFP 1 executes the printing process or MFP 1 is in a standby state.

Value T0 corresponds to an in-apparatus environment value in the preceding stabilization process, and value T corresponds to a current in-apparatus environment value. Specifically, the environment value is a temperature. Alternatively, the environment value may be a humidity, or a combination of a temperature and a humidity. Moreover, value T0 which is an in-apparatus environment value in the preceding stabilization process may be set depending on a type of the stabilization process, that is, may be set for each of the first stabilization process, the second stabilization process and the third stabilization process.

Threshold value ΔT1 is used when determination whether to execute the first stabilization process is made using the in-apparatus environment value. Threshold value ΔT2 is used when determination whether to execute the second stabilization process is made using the in-apparatus environment value. In a case where determination whether to execute the second stabilization process is made using a count of printed sheets of paper, that is, in a case where the second stabilization process is executed each time the count of printed sheets of paper reaches a predetermined count, threshold value CT2 is used for determining whether the count of printed sheets of paper reaches the predetermined count.

Level L1 corresponds to the frequency level of execution of the first stabilization process, and level L2 corresponds to the frequency level of execution of the second stabilization process.

Figure 4:
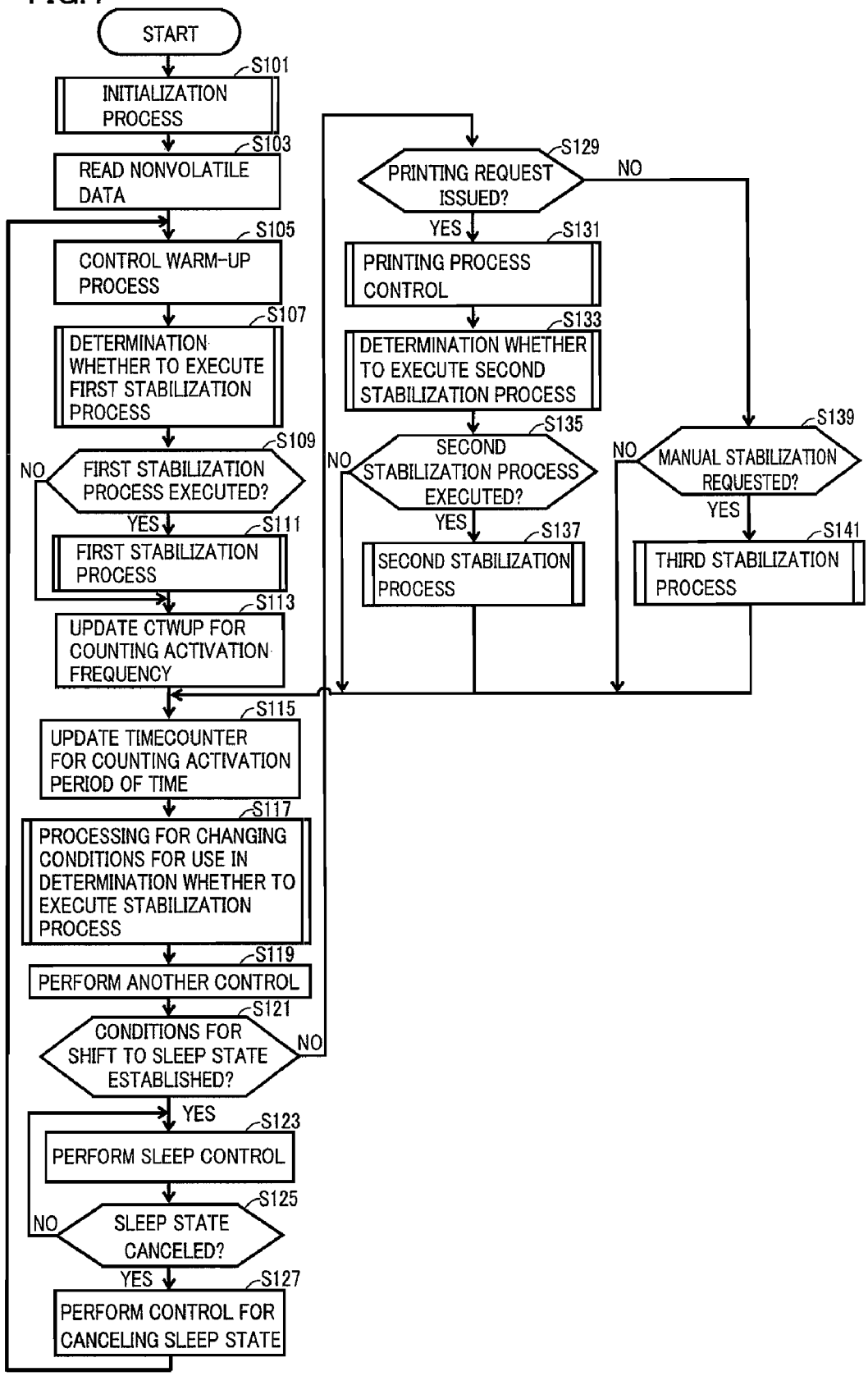
FIG. 4 is a flowchart showing a specific example of a flow of processing carried out by an engine controller of the MFP according to the embodiment.

A specific example of a flow of the processing carried out by engine controller 61 will be explained as follows by using FIG. 4. With reference to FIG. 4, engine controller 61 executes various initialization process (step S101). Next, engine controller 61 reads required data from nonvolatile memory 615 (step S103). Next, CPU 611 controls the warm-up process (step S105). After completion of the warm-up process, CPU 611 determines whether to execute the first stabilization process which is the stabilization process executed after execution of the warm-up process in the activation (step S107). When it is determined that the first stabilization process is executed (YES in step S109), CPU 611 carries out processing for executing the first stabilization process (step S111). In this processing, CPU 611 sends a request to execute the first stabilization process to printer controller 65. Then, IF controller 614 receives, from printer controller 65, an image pattern for use in the stabilization process, and an instruction to execute the stabilization process. CPU 611 executes the first stabilization process, based on the image pattern and the instruction.

Even when the first stabilization process is executed (YES in step S109) or even when the first stabilization process is not executed (NO in step S109), after execution of the warm-up process in the activation in step S105, CPU 611 updates counter CTWUP for counting the activation frequency (step S113), and then updates timer TIMECOUNTER for counting the activation period of time (step S115). Next, CPU 611 executes processing for changing conditions such as a threshold value for use in determination whether to execute the stabilization process (step S117). Next, CPU 611 performs another control if necessary (step S119); however, this control is not particularly limited.

Next, CPU 611 determines whether predetermined conditions for shift to the sleep state are established (step S121). Herein, a method for the determination is not particularly limited. When it is determined that the conditions for shift to the sleep state are established (YES in step S121), CPU 611 performs control such that MFP 1 shifts to the sleep state (step S123). In the sleep state, CPU 611 determines whether conditions for canceling the sleep state are established (step S125). Herein, a method for the determination is not particularly limited. When it is determined that the conditions for canceling the sleep state are established (YES in step S125), CPU 611 performs control for canceling the sleep state (step S127).

In the state other than the sleep state, that is, in the activation state, when IF controller 614 receives a request to execute the printing process transmitted in accordance with processing carried out by printer controller 65 (YES in step 129), CPU 611 performs control of the printing process (step S131). Next, CPU 611 determines whether to execute the second stabilization process which is the stabilization process executed in the printing state (step S133). When it is determined that the second stabilization process is executed (YES in step S135), CPU 611 carries out processing for executing the second stabilization process (step S137). In the activation state, on the other hand, when IF controller 614 receives a request to execute the stabilization process based on a user's instruction, which is transmitted in accordance with processing carried out by printer controller 65 (YES in step S139), CPU 611 carries out processing for executing the third stabilization process which is the stabilization process executed based on the user's instruction (step S141). Upon execution of the second stabilization process or the third stabilization process, CPU 611 sends a request to execute the second stabilization process or the third stabilization process to printer controller 65, and IF controller 614 receives an image pattern for use in the stabilization process and an instruction to execute the stabilization process, each of which is transmitted thereto in accordance with processing carried out by printer controller 65. CPU 611 executes the second stabilization process or the third stabilization process, based on the image pattern and the instruction. Thereafter, the procedure returns to step S115, and CPU 611 carries out the foregoing processing repeatedly.

Figure 5:
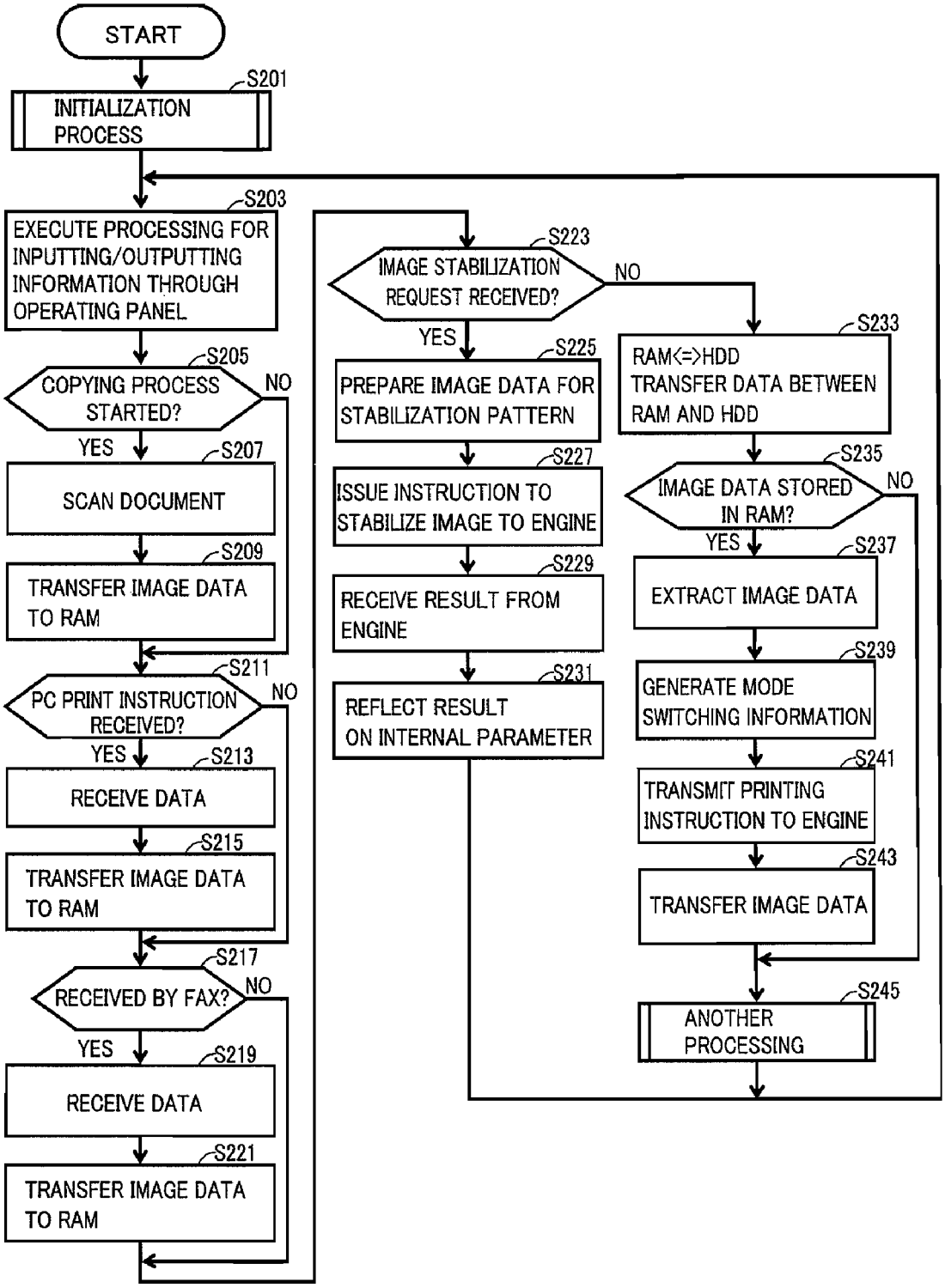
FIG. 5 is a flowchart showing a specific example of a flow of processing carried out by a printer controller part of the MFP according to the embodiment.

A specific example of a flow of the processing carried out by printer controller 65 will be explained as follows by using FIG. 5. With reference to FIG. 5, first, printer controller 65 executes various initialization process (step S201). Next, panel controller 653 carries out processing for inputting/outputting information through the operating panel (not shown) (step S203).

When an operating signal inputted through the operating panel is a signal to instruct start of a copying process (YES in step S205), image processing controller 651 outputs a control signal to scanner device 10, so that scanner device 10 scans a document to obtain image data (step S207). Next, image processing controller 651 transfers the received image data to RAM 613 of engine controller 61 (step S209).

When an instruction to output image data transmitted from an external device such as a PC, that is, a PC print instruction is received through external device IF 70 (YES in step S211), image processing controller 651 receives the image data from the external device through external device IF 70 (step S213). Next, image processing controller 651 transfers the received image data to RAM 613 of engine controller 61 (step S213).

When an instruction to print the image data is received through FAX line IF 80 via a FAX line (YES in step S217), image processing controller 651 receives image data from a device, which transmits the image data by FAX, through FAX line IF 80 (step S219). Next, image processing controller 651 transfers the received image data to RAM 613 of engine controller 61 (step S221).

RAM 613 temporarily stores the image data transferred thereto in step S209, the image data transferred thereto in step S215 or the image data transferred thereto in step S221. Alternatively, the image data may be transferred to and stored in another memory device such as an HDD (not shown) if necessary. This image data transfer is performed in a case where RAM 613 receives image data which is large in data amount, such as text data having a large number of pages. After completion of the image data transfer, when the amount of image data stored in RAM 613 becomes not more than a predetermined amount, preferably, the image data is sent back from the HDD to RAM 613 in succession.

When no signal to request execution of the stabilization process is inputted through engine controller 61 or the operating panel, that is, when engine controller 61 determines that the stabilization process should not be executed yet (NO in step S223), the image data transfer described above is performed between RAM 613 and the HDD (step S233). After completion of the image data transfer, when RAM 613 stores image data to be printed (YES in step S235), image processing controller 651 extracts the image data from RAM 613 through IF controller 614 of engine controller 61 (step S237). Next, image processing controller 651 accesses the management information correlated with the image data to generate information for switching a printing mode such as color settings, sheet feed settings, and one-sided print or double-sided print settings to a suitable mode (step S239). Next, image processing controller 651 transmits, to engine controller 61, the information generated in step S239 and a printing command (step S241). Next, image processing controller 651 establishes serial communications with engine controller 61 to transfer the image data to engine controller 61 at a predetermined timing (step S243). Engine controller 61 executes the printing process based on the printing command to execute an image formation process for the image data transferred in step S243.

When a signal to request execution of the stabilization process is inputted through engine controller 61 or the operating panel, that is, when engine controller 61 determines that the stabilization process should be executed now or when the user issues an instruction to execute the stabilization process (YES in step S223), image processing controller 651 prepares pre-stored image data of a pattern image for use in the stabilization process, in accordance with the signal (step S225). Next, image processing controller 651 transfers the image data to engine controller 61 and transmits a command to execute the stabilization process to engine controller 61 (step S227). Engine controller 61 executes the stabilization process in accordance with this command, and inputs a result of the stabilization process to printer controller 65. Next, image processing controller 651 receives the result of the stabilization process from engine controller 61 (step S229). Next, image processing controller 651 reflects the result on internal parameters (step S231).

Figure 6:
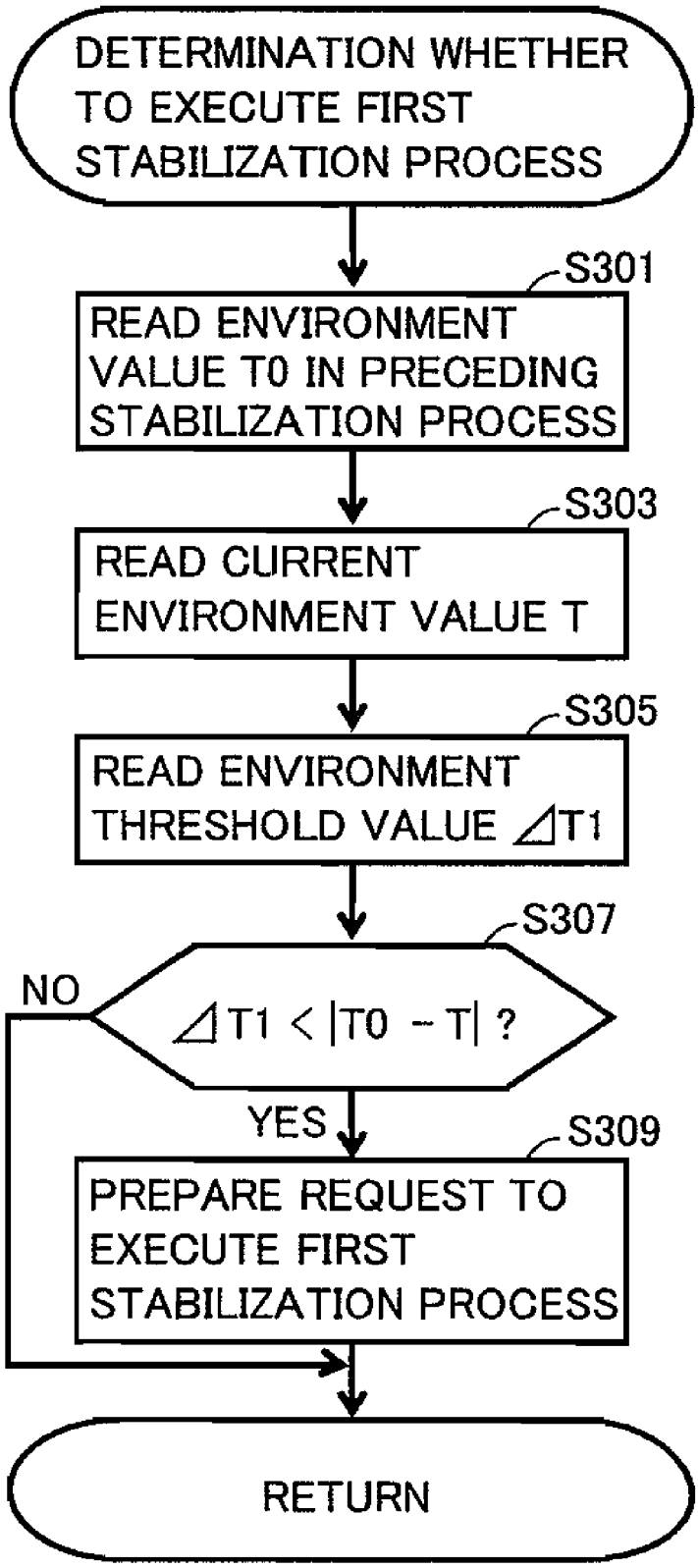
FIG. 6 is a flowchart showing a specific example of a flow of processing for determining whether to execute a first stabilization process.

A specific example of a flow of the processing for determining whether to execute the first stabilization process will be explained as follows by using FIG. 6. This processing is carried out by engine controller 61 in step S107. With reference to FIG. 6, first, CPU 611 reads environment value T0 in the preceding stabilization process from nonvolatile memory 615 (step S301). Next, CPU 611 receives current environment value T from environment sensor 617 through expansion I/O 616 (step S303). Next, CPU 611 reads threshold value ΔT1 described above from nonvolatile memory 615 (step S305).

Next, CPU 611 compares a difference between environment value T0 and environment value T with threshold value ΔT1 (step S307). When the difference is larger than threshold value ΔT1 (YES in step S307), CPU 611 determines to execute the first stabilization process, and prepares a request to execute the first stabilization process (step S309). More specifically, when an in-apparatus temperature (T) which is a current in-apparatus environment value varies from an in-apparatus temperature (T0) in the preceding stabilization process to a value which is not less than a threshold value (ΔT1), CPU 611 determines to execute the first stabilization process. When the condition described above is not established (NO in step S307), CPU 611 determines to execute no first stabilization process.

Figure 7:
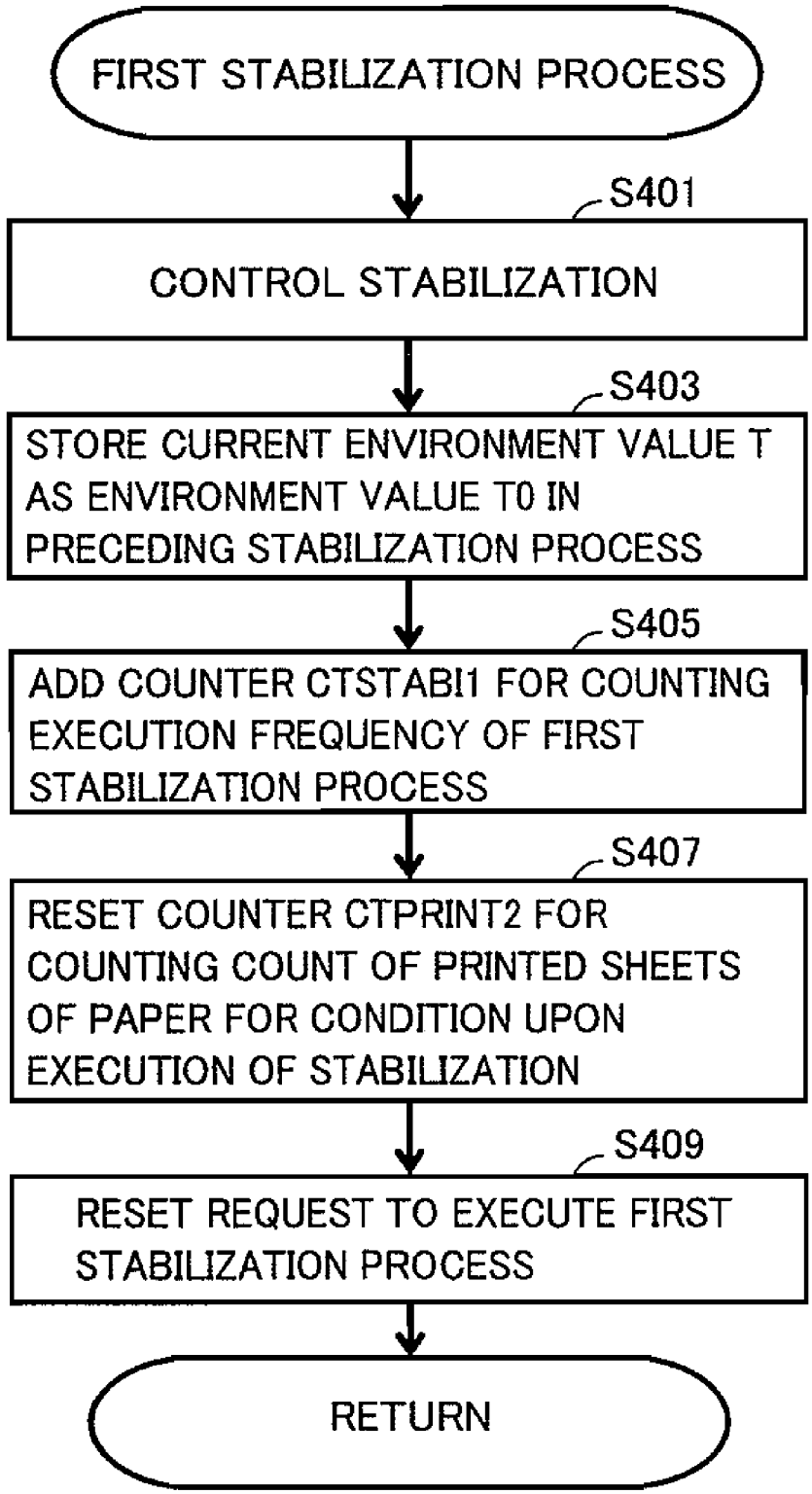
FIG. 7 is a flowchart showing a specific example of a flow of processing for executing the first stabilization process.

A specific example of a flow of the processing for executing the first stabilization process will be explained as follows by using FIG. 7. This processing is carried out by engine controller 61 in step S111. With reference to FIG. 7, first, CPU 611 outputs required control signals to the respective parts to control the respective parts so as to execute the stabilization process similar to that shown in FIG. 24 (step S401). After the control of the stabilization process, CPU 611 receives environment value T such as a current in-apparatus temperature from environment sensor 617 through expansion I/O 616 and allows nonvolatile memory 615 to store current environment value T as environment value T0 in the preceding stabilization process (step S403). Next, CPU 611 performs addition of counter CTSTABI1 for counting the execution frequency of the first stabilization process (step S405). Next, CPU 611 resets counter CTPRINT2 for keeping the count of printed sheets of paper since the stabilization process is executed (step S407). Next, CPU 611 resets the request to execute the first stabilization process (step S409).

Figure 8:
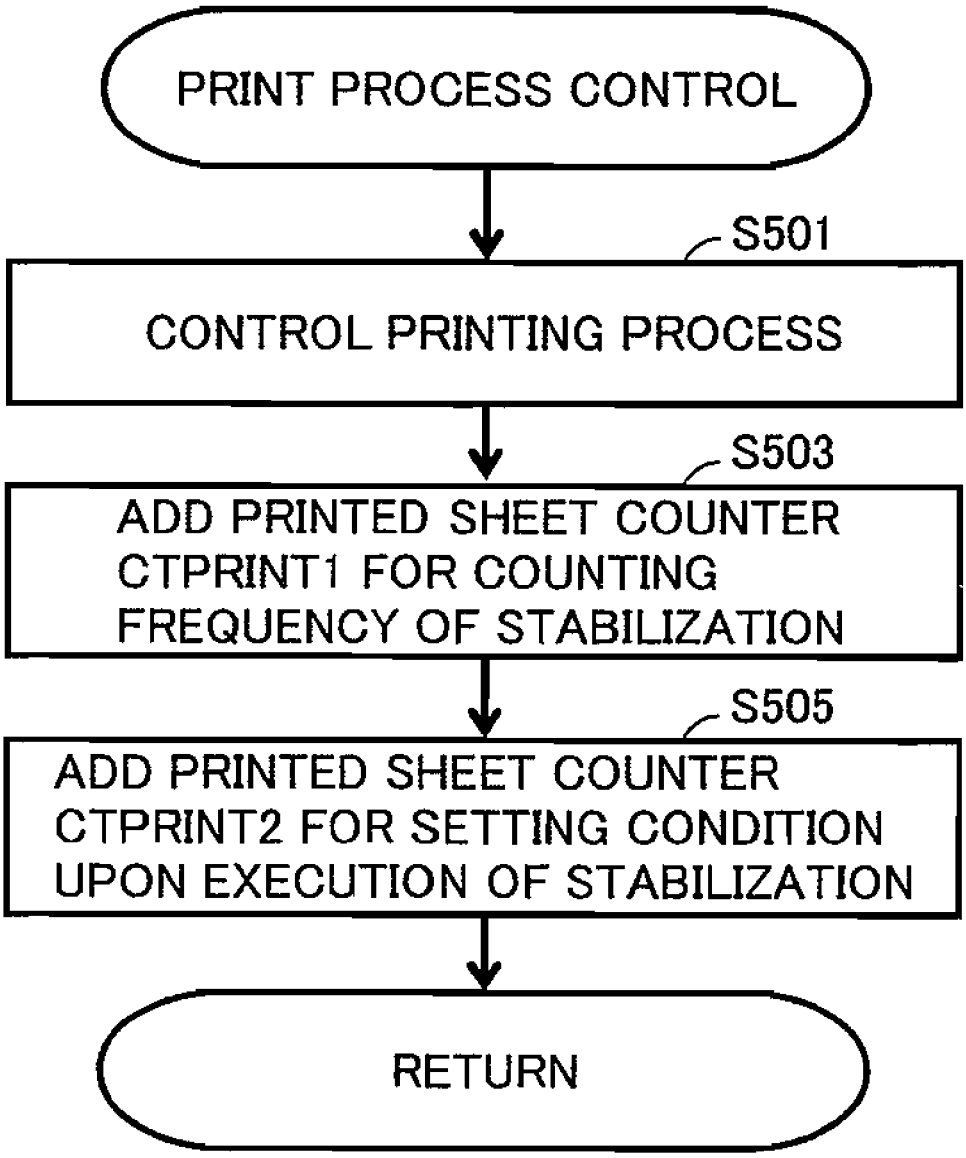
FIG. 8 is a flowchart showing a specific example of a flow of control of a printing process.

A specific example of a flow of the control of the printing process will be explained as follows by using FIG. 8. This control is performed by engine controller 61 in step S131. With reference to FIG. 8, first, CPU 611 outputs required control signals to the respective parts to control the respective parts so as to execute the printing process (step S501). After the control of the printing process, CPU 611 performs addition of counter CTPRINT1 for keeping the count of printed sheets of paper since the processing for changing the frequency level of execution of the preceding stabilization process is carried out (step S503). Next, CPU 611 performs addition of counter CTPRINT2 for keeping the count of printed sheets of paper since the preceding stabilization process is executed (step S505).

Figure 9:
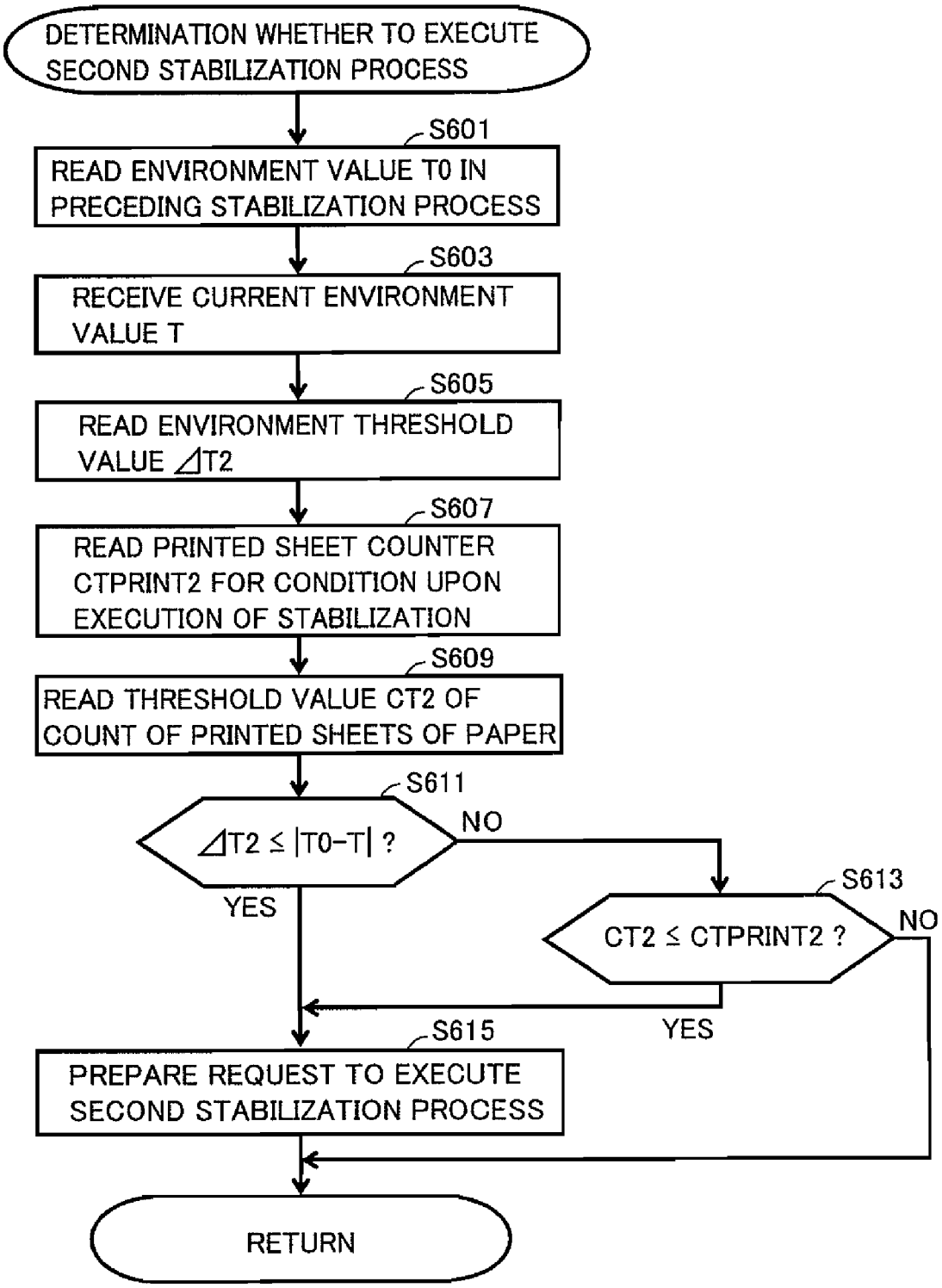
FIG. 9 is a flowchart showing a specific example of a flow of processing for determining whether to execute a second stabilization process.

A specific example of a flow of the processing for determining whether to execute the second stabilization process, will be explained as follows by using FIG. 9. This processing is carried out by engine controller 61 in step S133. With reference to FIG. 9, first, CPU 611 reads environment value T0 in the preceding stabilization process from nonvolatile memory 615 (step S601). Next, CPU 611 receives current environment value T from environment sensor 617 through expansion I/O 616 (step S603). Next, CPU 611 reads threshold value ΔT2 from nonvolatile memory 615 (step S605). Next, CPU 611 reads the counted value corresponding to the count of printed sheets of paper kept since the preceding stabilization process is executed, from counter CTPRINT2 stored in nonvolatile memory 615 (step S607). Next, CPU 611 reads threshold value CT2 from nonvolatile memory 615 (step S609).

Next, CPU 611 compares a difference between environment value T0 and environment value T with threshold value ΔT2 (step S611). When the difference is not less than threshold value ΔT2 (YES in step S611), CPU 611 determines to execute the second stabilization process and prepares a request to execute the second stabilization process (step S615). Even in a case where the difference is smaller than threshold value ΔT2 (NO in step S611), when the counted value of counter CTPRINT2 is not less than threshold value CT2 (YES in step S613), CPU 611 determines to execute the second stabilization process and prepares the request to execute the second stabilization process (step S615). More specifically, in a case where the in-apparatus temperature (T) corresponding to the current in-apparatus environment value varies from the in-apparatus temperature (T0) in the preceding stabilization process to a value which is not less than the threshold value (ΔT2) or in a case where the count of printed sheets of paper (CTPRINT2) kept since the preceding stabilization process is executed reaches the count of sheets of paper (CT2) corresponding to the threshold value, CPU 611 determines to execute the second stabilization process. When a case other than the cases described above occurs (NO in step S611 and NO in step S613), CPU 611 determines to execute no second stabilization process.

Figure 10:
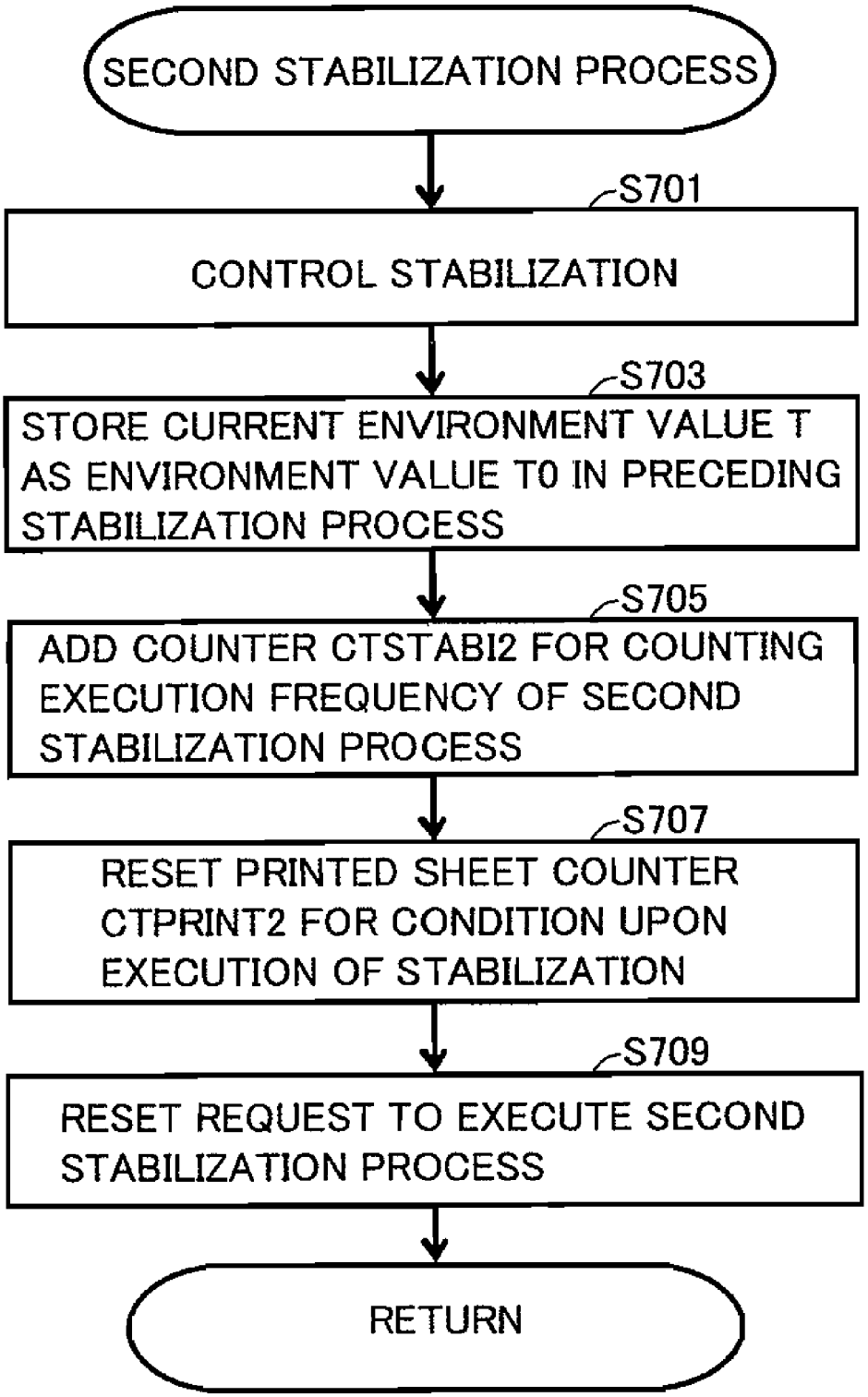
FIG. 10 is a flowchart showing a specific example of a flow of processing for executing the second stabilization process.

A specific example of a flow of the processing for executing the second stabilization process, will be explained as follows by using FIG. 10. This processing is carried out by engine controller 61 in step S137. With reference to FIG. 10, first, CPU 611 outputs required control signals to the respective parts to control the respective parts so as to execute the stabilization process similar to that shown in FIG. 24 (step S701). After the control of the stabilization process, CPU 611 receives environment value T such as a current in-apparatus temperature from environment sensor 617 through expansion I/O 616 and allows nonvolatile memory 615 to store current environment value T as environment value T0 in the preceding stabilization process (step S703). Next, CPU 611 performs addition of counter CTSTABI2 for counting the execution frequency of the second stabilization process (step S705). Next, CPU 611 resets counter CTPRINT2 for keeping the count of printed sheets of paper since the preceding stabilization process is executed (step S707). Next, CPU 611 resets the request to execute the second stabilization process (step S709).

In step S223, printer controller 65 receives the request to execute the stabilization process from the user through the operating panel (not shown in FIG. 1). In step S227, printer controller 65 transmits the instruction to execute the stabilization process to engine controller 61. Herein, engine controller 61 performs an analysis on the instruction to determine that the user issues the request to execute the stabilization process in step S139.

Figure 11A:
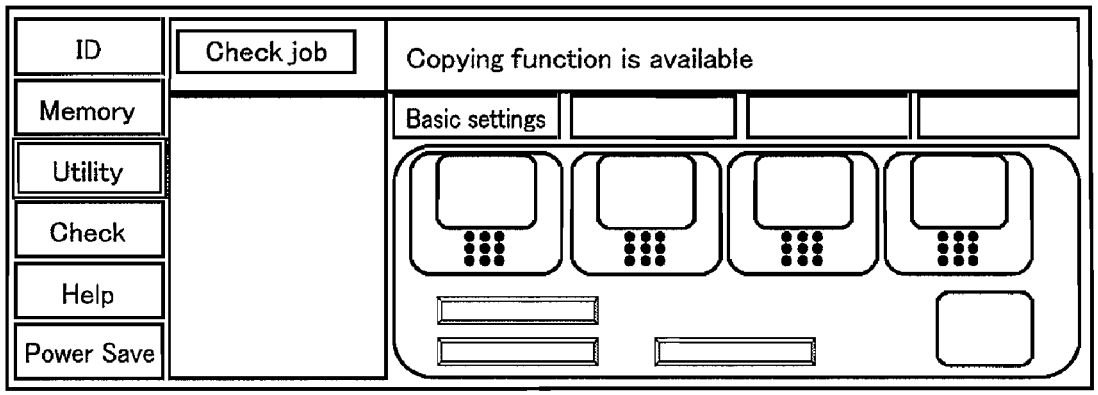
FIGS. 11A to 11C show examples of display on an operating panel.
Figure 11B:
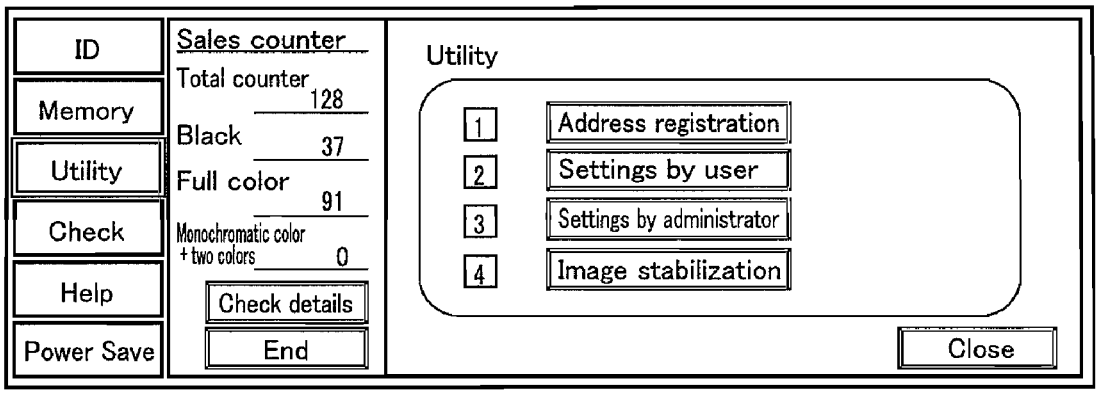
Figure 11C:
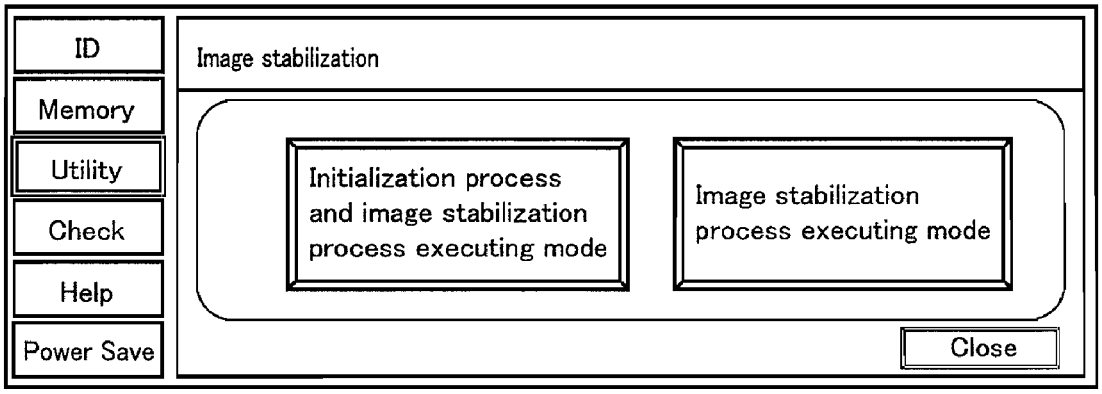

A specific example of a manipulation to issue an instruction to execute the stabilization process in the operating panel will be explained as follows by using FIGS. 11A to 11C. FIG. 11A shows a specific example of a basic display state. As shown in FIGS. 11A to 11C, the operating panel has various buttons. When the user presses the "Utility" button in order to perform utility settings, the display shown in FIG. 11A is switched to that shown in FIG. 11B. FIG. 11B shows details of the utility settings. When the user presses the "Image stabilization" button in order to issue an instruction to execute the stabilization process, the display shown in FIG. 11B is switched to that shown in FIG. 11C. FIG. 11C shows two types of the stabilization process. It is assumed herein that MFP 1 executes only the stabilization process or executes the initialization process in addition to the stabilization process. When the user presses the button for executing only the stabilization process, a request to execute the stabilization process is inputted to printer controller 65 through the operating panel.

Figure 12:
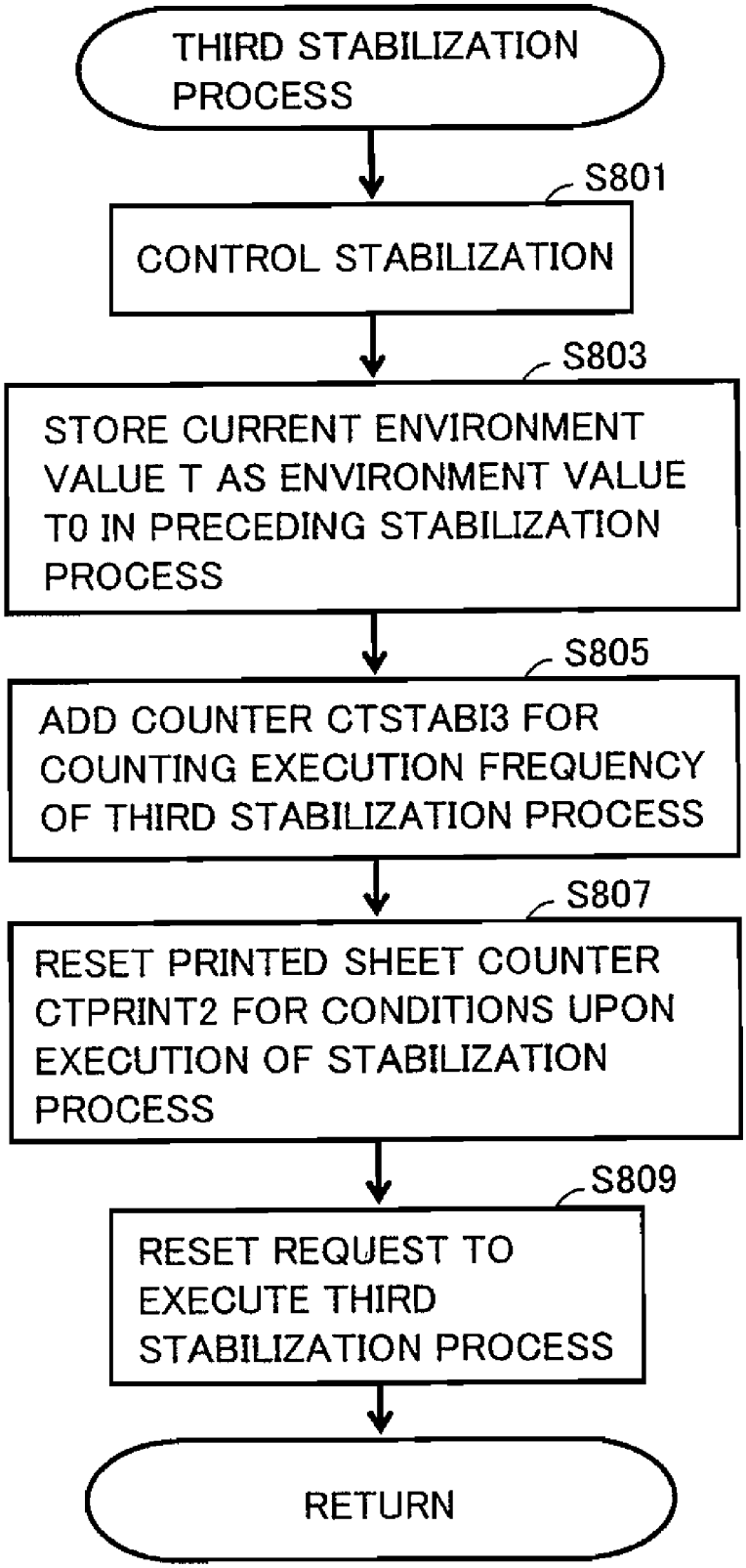
FIG. 12 is a flowchart showing a specific example of a flow of processing for executing a third stabilization process.

A specific example of a flow of the processing for executing the stabilization process to be executed based on a user's instruction, that is, the third stabilization process, will be explained as follows by using FIG. 12. This processing is carried out by engine controller 61 in step S141. With reference to FIG. 12, first, CPU 611 outputs required control signals to the respective parts to control the respective parts so as to execute the stabilization process similar to that shown in FIG. 24 (step S801). After the control of the stabilization process, CPU 611 receives environment value T such as a current in-apparatus temperature from environment sensor 617 through expansion I/O 616 and allows nonvolatile memory 615 to store current environment value T as environment value T0 in the preceding stabilization process (step S803). Next, CPU 611 performs addition of counter CTSTABI3 for counting the execution frequency of the third stabilization process (step S805). Next, CPU 611 resets counter CTPRINT2 for keeping the count of printed sheets of paper since the stabilization process is executed (step S807). Next, CPU 611 resets the request to execute the third stabilization process (step S809).

The processing carried out by engine controller 61 in step S117, that is, the processing for changing the conditions upon execution of the stabilization process, such as the threshold value used for determining whether to execute the stabilization process, refers to processing for determining whether to raise, lower or maintain the frequency level of execution of the first stabilization process and the second stabilization process executed automatically, based on a frequency of issuing the request to execute the third stabilization process by the user. Herein, the "processing for changing the conditions" involves the case where the frequency level is maintained.

A first specific example of a flow of the processing described above will be explained as follows by using FIG. 13. In the first specific example, CPU 611 determines whether to change the conditions upon execution of the stabilization process, based on the execution frequency (CTSTABI3) of the third stabilization process counted each time a count of printed sheets of paper reaches a predetermined count. For example, the predetermined count may be 10000. The value of 10000 is an assumed count of printed sheets of paper for about one month. Specifically, it is assumed that in a case where the third stabilization process is executed three times or more during one month, the user has a complaint regarding image quality. Therefore, CPU 611 determines to raise the frequency level of execution of the stabilization process. On the other hand, it is assumed that in a case where the third stabilization process is executed less than two times during one month, image quality obtained herein exceeds that desired by the user. Therefore, CPU 611 determines to lower the frequency level of execution of the stabilization process. The threshold value of the count or the frequency is merely an example and is not limited to the value described above. In particular, the "predetermined count" varies depending on a printing speed and a use environment of MFP 1.

Figure 13:
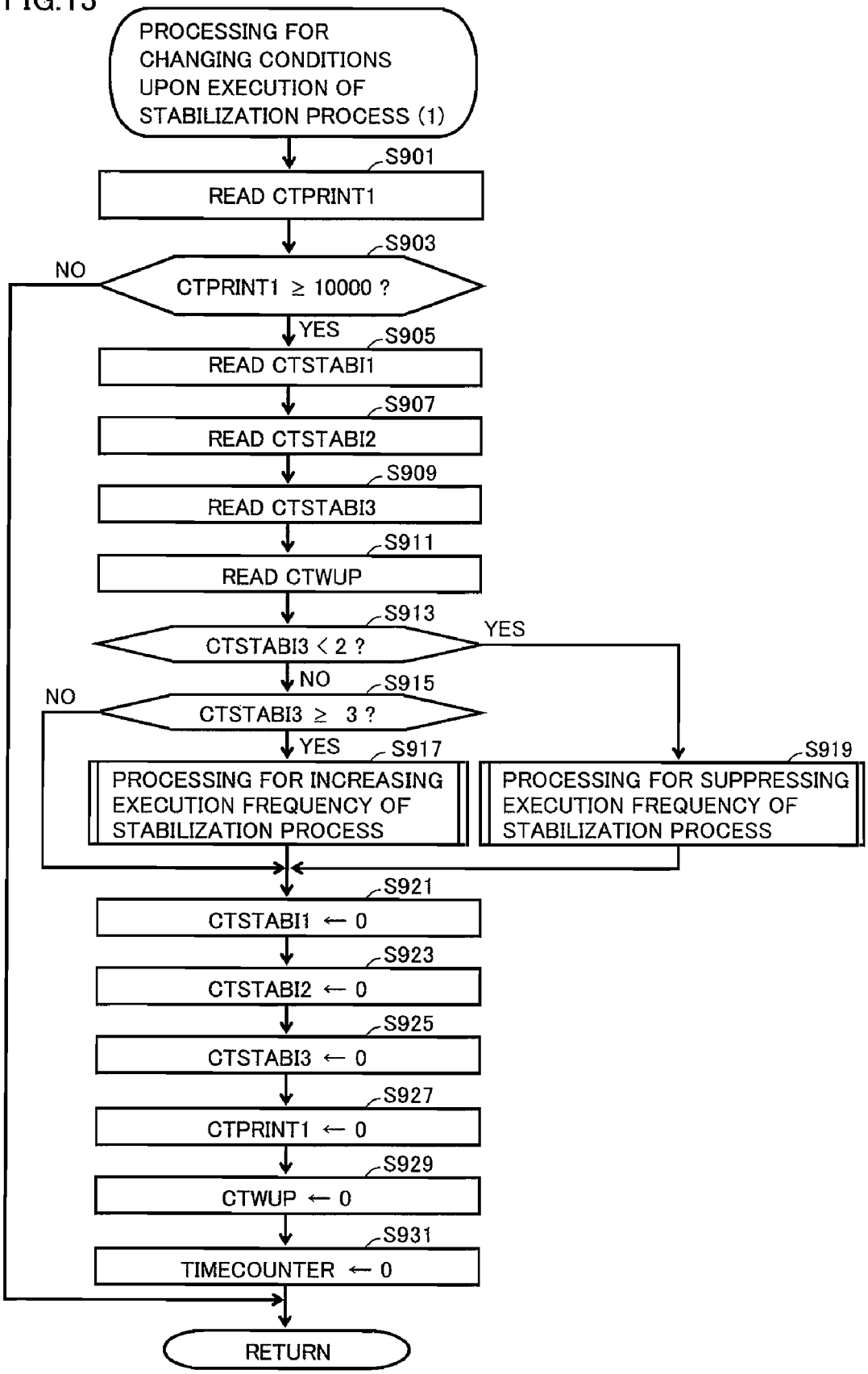
FIG. 13 is a flowchart showing a first specific example of a flow of processing for determining whether to raise, lower or maintain a frequency level of the first and second stabilization processes executed automatically, based on a frequency of issuing a request to execute the third stabilization process.

With reference to FIG. 13, first, CPU 611 reads a value of a count of printed sheets of paper, which is kept since the processing for changing the frequency level of execution of the preceding stabilization process is carried out, from counter CTPRINT1 stored in nonvolatile memory 615 (step S901). Next, CPU 611 compares the counted value of counter CTPRINT1 with the "predetermined count", that is, 10000 (step S903). When the counted value of counter CTPRINT1 is not less than the predetermined count (YES in step S903), CPU 611 determines to change the conditions upon execution of the stabilization process and carries out the subsequent processing. On the other hand, when the counted value of counter CTPRINT1 is less than the predetermined count (NO in step S903), CPU 611 determines to change no conditions upon execution of the stabilization process and skips the subsequent processing to complete the processing. More specifically, each time the count of printed sheets of paper, which is kept since the processing for changing the frequency level of execution of the preceding stabilization process is carried out, reaches a preset count, CPU 611 carries out the processing in and subsequent to step S905 and determines whether to raise, lower or maintain the frequency level of execution of the stabilization process.

Next, CPU 611 reads a value of the execution frequency of the first stabilization process, which is counted since the processing for changing the frequency level of execution of the preceding stabilization process is carried out, from counter CTSTABI1 stored in nonvolatile memory 615 (step S905). Next, CPU 611 reads a value of the execution frequency of the second stabilization process, which is counted since the processing for changing the frequency level of execution of the preceding stabilization process is carried out, from counter CTSTABI2 stored in nonvolatile memory 615 (step S907). Next, CPU 611 reads a value of the execution frequency of the third stabilization process, which is counted since the processing for changing the frequency level of execution of the preceding stabilization process is carried out, from counter CTSTABI3 stored in nonvolatile memory 615 (step S909). Next, CPU 611 reads a value of the activation frequency of MFP 1, which is counted since the processing for changing the frequency level of execution of the preceding stabilization process is carried out, from counter CTWUP stored in nonvolatile memory 615 (step S911).

Next, CPU 611 compares the counted value of counter CTSTABI3 which is read in step S909, that is, the execution frequency of the third stabilization process which is counted since the processing for changing the frequency level of execution of the preceding stabilization process is carried out, with "2" which is a threshold value for determining whether to lower the frequency level of execution of the stabilization process (step S913). When the counted value is not less than 2 (NO in step S913), CPU 611 further compares the counted value with "3" which is a threshold value for determining whether to raise the frequency level of execution of the stabilization process (step S915).

As a result of the comparison, when the counted value is not less than 3, that is, when the execution frequency of the third stabilization process, which is counted since the processing for changing the frequency level of execution of the preceding stabilization process is carried out, is not less than three times (NO in step S913 and YES in step S915), CPU 611 determines to raise the frequency level of execution of the stabilization process, and then carries out processing for raising the frequency level of execution of the stabilization process (step S917). On the other hand, when the counted value is less than 2, that is, when the execution frequency of the third stabilization process, which is counted since the processing for changing the frequency level of execution of the preceding stabilization process is carried out, is less than two times (YES in step S913), CPU 611 determines to lower the frequency level of execution of the stabilization process, and then carries out processing for suppressing the execution frequency of the stabilization process (step S919). Moreover, when the counted value is 2 (NO in step S913 and NO in step S915), CPU 611 determines to maintain the execution frequency of the stabilization process, and does not carry out the processing in step S917 and step S919.

After completion of the processing described above, CPU 611 resets counters CTSTABI1, CTSTABI2, CTSTABI3, CTPRINT1 and CTWUP (steps S921 to S929), and then resets timer TIMECOUNTER (step S931).

Figure 14:
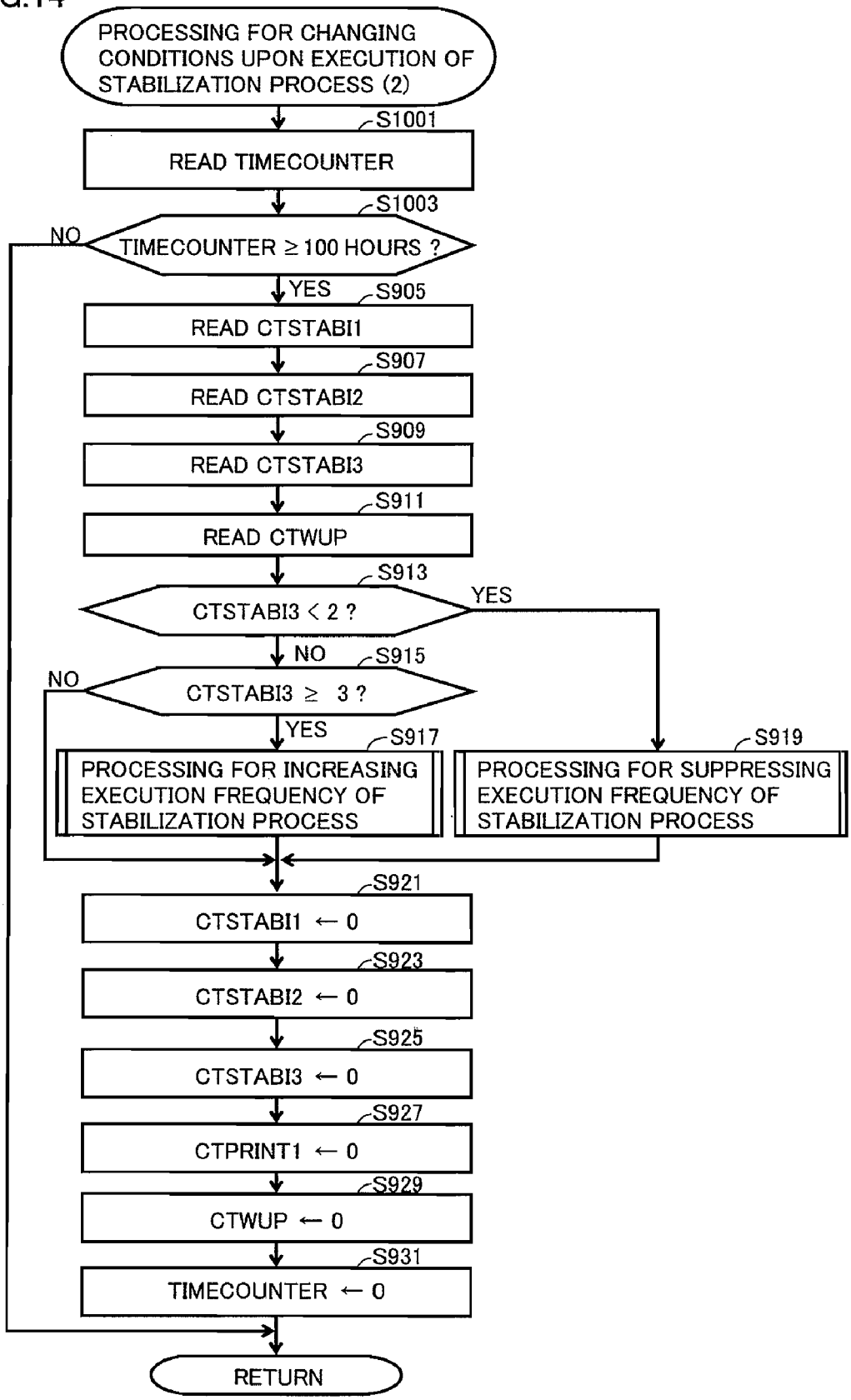
FIG. 14 is a flowchart showing a second specific example of a flow of the processing for determining whether to raise, lower or maintain the frequency level of the first and second stabilization processes executed automatically, based on the frequency of issuing the request to execute the third stabilization process.

A second specific example of a flow of the processing described above will be explained as follows by using FIG. 14. In the second specific example, CPU 611 determines whether to change the conditions upon execution of the stabilization process, based on the execution frequency (CTSTABI3) of the third stabilization process, for each predetermined activation period of time. For example, the predetermined activation period of time may be 200 hours. Herein, a period of time during which MFP 1 is in a sleep state is 100 hours (50%), and an activation period of time (actual activation period of time) during which MFP 1 is in an activation state rather than the sleep state is 100 hours. The value of "100 hours" is an assumed activation period of time for about one month. As in the case of the first specific example, also in the second specific example, in a case where the third stabilization process is executed three times or more during one month, the user has a complaint regarding image quality. Therefore, CPU 611 determines to raise the frequency level of execution of the stabilization process. On the other hand, in a case where the third stabilization process is executed less than two times during one month, image quality obtained herein exceeds that desired by the user. Therefore, CPU 611 determines to lower the frequency level of execution of the stabilization process. That is, the processing in the second specific example shown in FIG. 14 is different in steps S901 and S903 from the processing in the first specific example shown in FIG. 13. Herein, the threshold value of the activation period of time is merely an example; therefore, the present invention is not limited to these values.

With reference to FIG. 14, first, CPU 611 reads a value of the activation period of time of MFP 1, which is counted since the processing for changing the frequency level of execution of the preceding stabilization process is carried out, from timer TIMECOUNTER stored in nonvolatile memory 615 (step S1001). Next, CPU 611 compares the counted value of timer TIMECOUNTER with the "predetermined activation period of time", that is, 100 hours (step S1003). When the counted value of timer TIMECOUNTER is not less than the predetermined activation period of time (YES in step S1003), CPU 611 determines to change the conditions upon execution of the stabilization process, and carries out the subsequent processing similar to that in the first specific example. On the other hand, when the counted value of timer TIMECOUNTER is less than the predetermined activation period of time (NO in step S1003), CPU 611 determines to change no conditions upon execution of the stabilization process, and skips the subsequent processing to complete the processing. More specifically, each time the actual activation period of time, which is elapsed since the processing for changing the frequency level of execution of the preceding stabilization process is carried out, reaches the preset period of time, CPU 611 carries out the processing in and subsequent to step S905 similar to that in the first specific example and determines whether to raise, lower or maintain the frequency level of execution of the stabilization process.

A specific example of a flow of the processing for raising the frequency level of execution of the stabilization process, will be explained as follows by using FIG. 15. This processing is carried out in step S917. In a case where the frequency level of execution of the first stabilization process is already high, the frequency level of execution of the second stabilization process rather than the first stabilization process is raised, so that the frequency level of execution of the entire stabilization processes is raised effectively. Therefore, CPU 611 carries out the processing, based on the execution frequency (CTSTABI1) of the first stabilization process which is counted since the processing for changing the frequency level of execution of the preceding stabilization process is carried out. Herein, determination that the execution frequency of the first stabilization process is large or small varies depending on the frequency level of execution of the first stabilization process. That is, in a case where frequency level L1 of execution of the first stabilization process is high, the state that "the execution frequency is large" refers to a state that the first stabilization process is executed by a frequency which is larger than a case where frequency level L1 is normal or a case where frequency level L1 is low. Preferably, at the time of carrying out the processing, based on the execution frequency (CTSTABI1) of the first stabilization process, CPU 611 takes frequency level L1 of execution of the first stabilization process into consideration.

Further, in a case where a sum of a frequency of turn-on of MFP 1 or a frequency of return from the sleep state in MFP 1, that is, an execution frequency of the warm-up process is smaller than a predetermined frequency, the execution frequency of the first stabilization process is small. Herein, the "predetermined frequency" may be 100. However, the threshold value of this frequency is merely an example and is not limited to 100. Therefore, if the execution frequency of the warm-up process is smaller than the predetermined frequency, even when the frequency level of execution of the first stabilization process is raised, the execution frequency of the entire stabilization processes is not increased effectively. Thus, CPU 611 carries out the processing, based on the execution frequency (CTWUP) of the warm-up process. In order to carry out the processing for raising the frequency level of execution of the stabilization process, engine controller 61 adopts the execution frequency (CTSTABI1) of the first stabilization process. Herein, the use of frequency level L1 of execution of the first stabilization process is not essential. However, frequency level L1 is used preferably in order to determine the substantial "execution frequency". The same things hold true for the processing of suppressing the execution frequency of the stabilization process (to be described later). Further, the use of the execution frequency (CTWUP) of the warm-up process is not essential. However, the execution frequency (CTWUP) of the warm-up process is used preferably in order to improve the effect of increasing the execution frequency of the entire stabilization processes.

Figure 15:
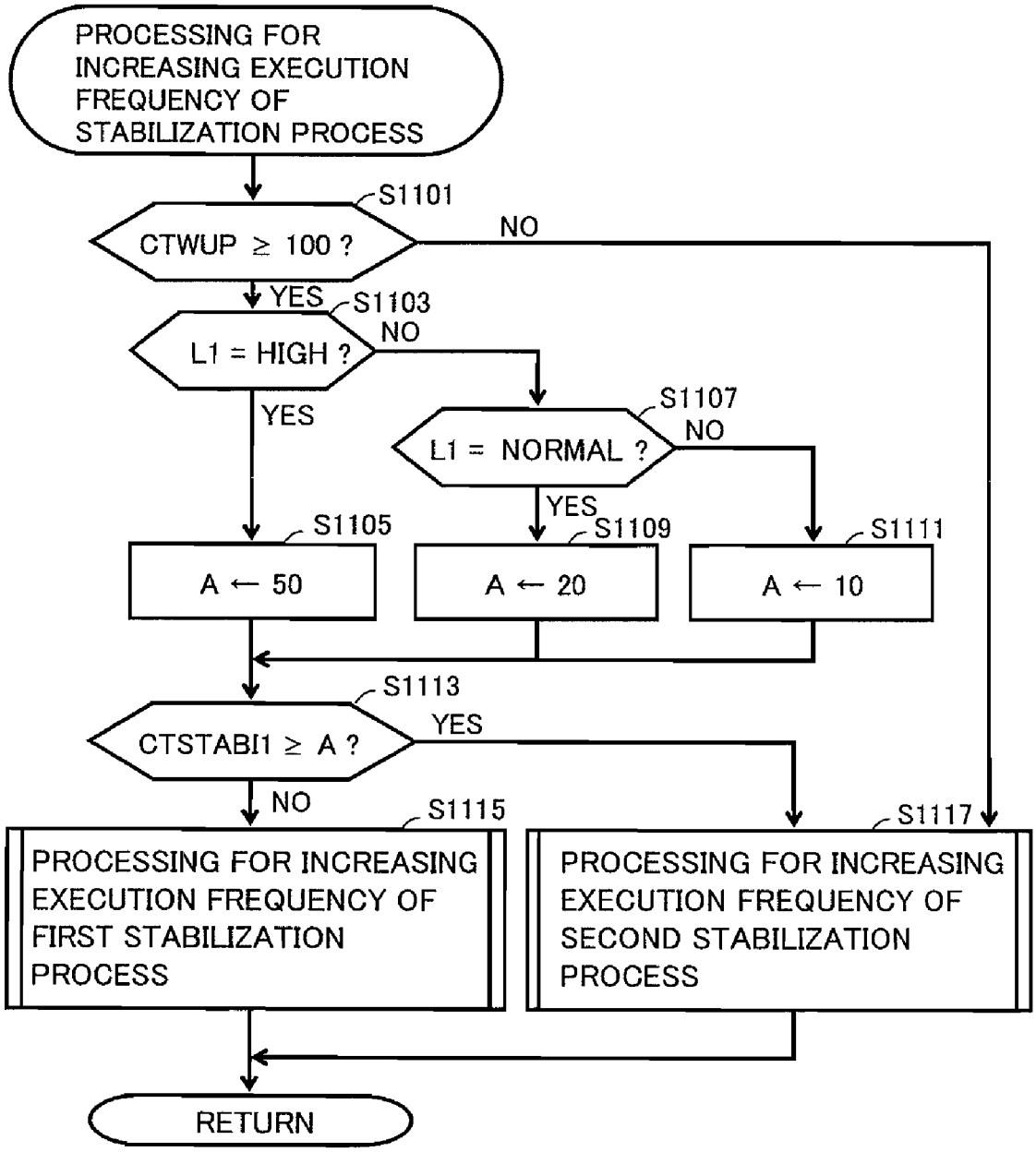
FIG. 15 is a flowchart showing a specific example of a flow of processing for raising the frequency level of execution of the stabilization process.

With reference to FIG. 15, first, CPU 611 reads a value of the activation frequency of MFP 1, which is counted since the processing for changing the frequency level of execution of the preceding stabilization process is carried out, from counter CTWUP stored in nonvolatile memory 615, and compares this counted value with the "predetermined frequency", that is, 100 (step S1101).

When the counted value is not less than 100, that is, when the frequency of the warm-up process executed after turn-on or return from the sleep state is not less than 100 (YES in step S1101), CPU 611 reads frequency level L1 of execution of the first stabilization process, from nonvolatile memory 615. When frequency level L1 is set at "high" (YES in step S1103), CPU 611 sets, at "50", a threshold value A used for determining the execution frequency of the first stabilization process (step S1105). On the other hand, when frequency level L1 is set at "normal" (NO in step S1103 and YES in step S1107), CPU 611 sets, at "20", threshold value A used for determining the execution frequency of the first stabilization process (step S1109). Moreover, when frequency level L1 is set at "low" (NO in step S1103 and NO in step S1107), CPU 611 sets, at "10", threshold value A used for determining the execution frequency of the first stabilization process (step S1111). Herein, the specific value set as threshold value A is not limited to "50", "20" or "10". These values are stored previously in ROM 612 or the like while being correlated with frequency level L1 of execution of the first stabilization process.

Next, CPU 611 reads a value of the execution frequency of the first stabilization process, which is counted since the processing for changing the frequency level of execution of the preceding stabilization process is carried out, from counter CTSTABI1 stored in nonvolatile memory 615, and compares the counted value with threshold value A, that is, "50", "20" or "10" (step S1113). When the counted value is less than threshold value A (NO in step S1113), CPU 611 executes the processing for raising the frequency level of execution of the first stabilization process (step S1115). On the other hand, when the counted value is not less than threshold value A (YES in step S1113), CPU 611 carries out the processing for raising the frequency level of execution of the second stabilization process (step S1117). That is, if the first stabilization process is executed by a frequency which is not less than the predetermined frequency irrespective of frequency level L1 of execution of the first stabilization process, CPU 611 determines that it is effective to raise the frequency level of execution of the second stabilization process rather than the first stabilization process, and carries out the processing for raising the frequency level of execution of the second stabilization process. On the other hand, if the first stabilization process is executed by a frequency which is smaller than the predetermined frequency irrespective of frequency level L1 of execution of the first stabilization process, CPU 611 determines that it is effective to raise the frequency level of execution of the first stabilization process rather than the second stabilization process, and carries out the processing for raising the frequency level of execution of the first stabilization process.

In the comparison performed in step S1101, when the activation frequency of MFP 1, which is counted since the processing for changing the frequency level of execution of the preceding stabilization process is carried out, is less than the "predetermined frequency", that is, 100, in other words, when the frequency of the warm-up process executed after turn-on or return from the sleep state is less than 100 (NO in step S1101), CPU 611 carries out the processing for raising the frequency level of execution of the second stabilization process (step S1117). More specifically, when the frequency of the warm-up process executed after turn-on or return from the sleep state is smaller than the predetermined frequency, CPU 611 determines that the frequency level of execution of the entire stabilization processes is raised effectively when the frequency level of execution of the second stabilization process rather than the first stabilization process is raised, and carries out the processing for raising the frequency level of execution of the second stabilization process.

A first specific example and a second specific example of a flow of the processing for suppressing the execution frequency of the stabilization process will be explained as follows by using FIGS. 16 and 17. This processing is carried out in step S919. In the first specific example, when the execution frequency of the first stabilization process is larger than a predetermined frequency, engine controller 61 determines that the first stabilization process is executed excessively, and lowers the frequency level of execution of the first stabilization process. On the other hand, when the execution frequency of the first stabilization process is smaller than the predetermined frequency, engine controller 61 determines that the first stabilization process is executed properly, and lowers the frequency level of execution of the second stabilization process. In the second specific example, engine controller 61 lowers the frequency level of execution of the stabilization process which is executed excessively. More specifically, when the execution frequency of the second stabilization process is larger than the predetermined frequency, engine controller 61 determines that the second stabilization process is executed excessively, and lowers the frequency level of execution of the second stabilization process. On the other hand, when the execution frequency of the second stabilization process is smaller than the predetermined frequency, engine controller 61 determines that the second stabilization process is executed properly, and lowers the frequency level of execution of the first stabilization process.

Figure 16:
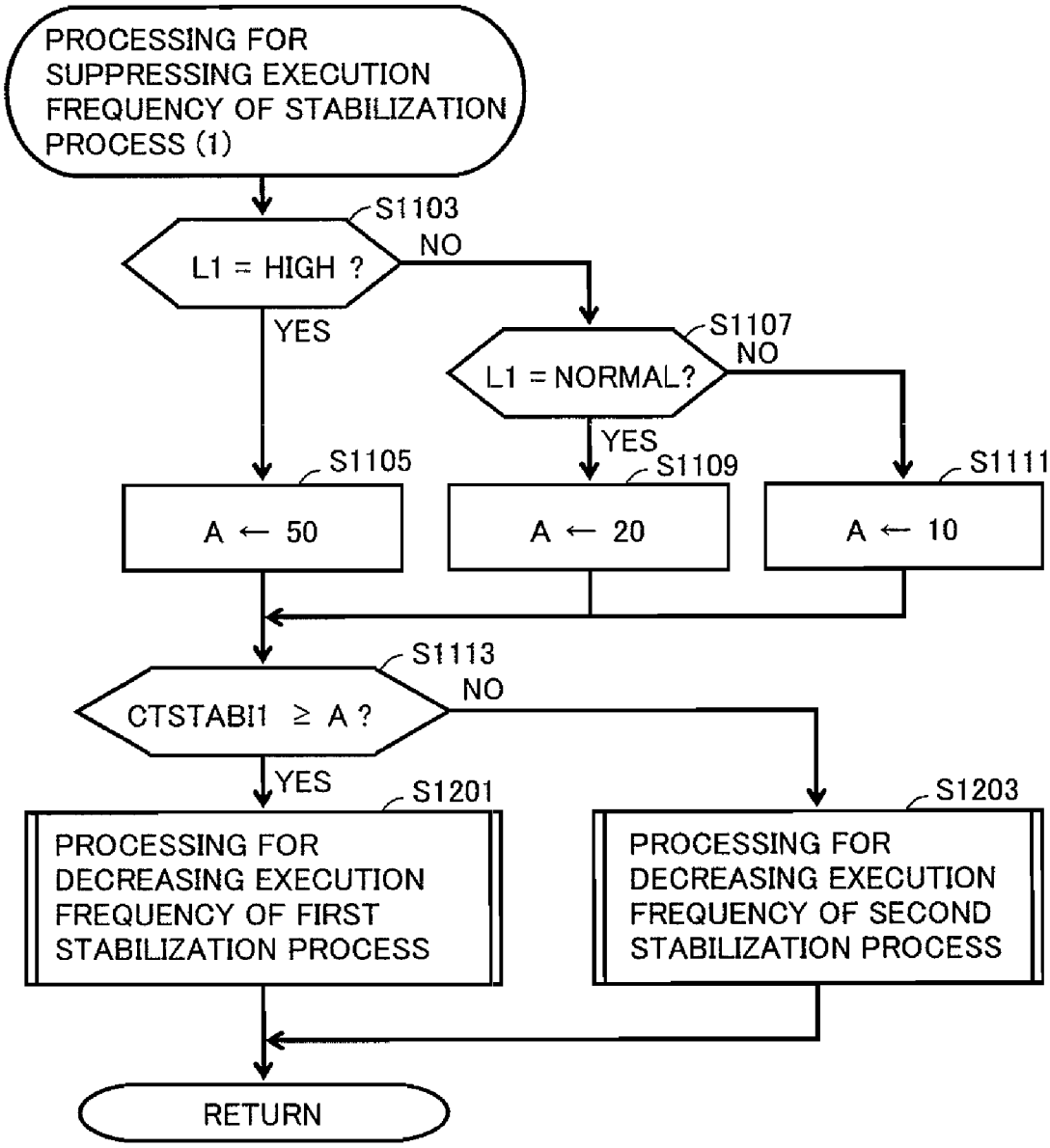
FIG. 16 is a flowchart showing a first specific example of a flow of processing for suppressing the execution frequency of the stabilization process.

With reference to FIG. 16, in the first specific example, CPU 611 carries out the processing which is similar to that in steps S1103 to S1111 shown in FIG. 15. Herein, a threshold value A used for determining the execution frequency of the first stabilization process is set for each level. Next, CPU 611 carries out the processing which is similar to that in step S113 shown in FIG. 15 to compare the execution frequency of the first stabilization process with set threshold value A.

In the first specific example of the processing for suppressing the execution frequency of the stabilization process, when the counted value is not less than threshold value A (YES in step S1113), CPU 611 carries out the processing for lowering the frequency level of execution of the first stabilization process (step S1201). On the other hand, when the counted value is less than threshold value A (NO in step S113), CPU 611 carries out the processing for lowering the frequency level of execution of the second stabilization process (step S1203). That is, when the execution frequency of the first stabilization process is not less than the predetermined frequency irrespective of frequency level L1 of execution of the first stabilization process, CPU 611 determines that the execution frequency of the first stabilization process is large, and carries out the processing for lowering the frequency level of execution of the first stabilization process. On the other hand, when the execution frequency of the first stabilization process is smaller than the predetermined frequency irrespective of frequency level L1 of execution of the first stabilization process, CPU 611 determines that it is effective to lower the frequency level of execution of the second stabilization process rather than the first stabilization process, and carries out the processing for lowering the frequency level of execution of the second stabilization process.

Figure 17:
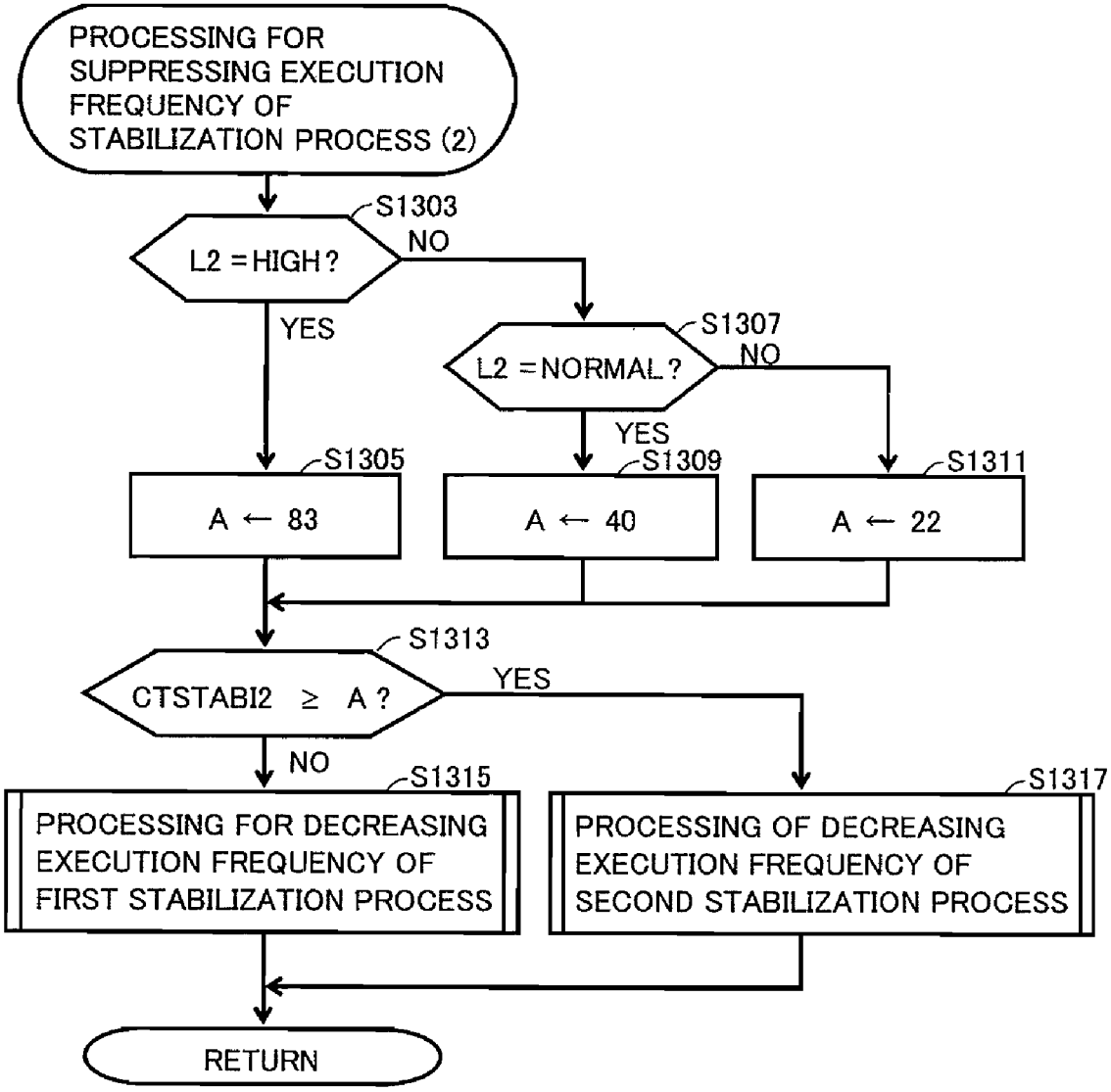
FIG. 17 is a flowchart showing a second specific example of a flow of the processing for suppressing the execution frequency of the stabilization process.

With reference to FIG. 17, in the second specific example, CPU 611 reads frequency level L2 of execution of the second stabilization process from nonvolatile memory 615. When frequency level L2 is set at "high" (YES in step S1303), CPU 611 sets, at "83", threshold value A used for determining the execution frequency of the second stabilization process (step S1305). When frequency level L2 is set at "normal" (NO in step S1303 and YES in step S1307), CPU 611 sets, at "40", threshold value A used for determining the execution frequency of the second stabilization process (step S1309). When frequency level L2 is set at "low" (NO in step S1303 and NO step S1307), CPU 611 sets, at "22", threshold value A used for determining the execution frequency of the second stabilization process (step S1311). Herein, the specific value set as threshold value A is not limited to "83", "40" or "22". This value is stored previously in ROM 612 or the like while being correlated with frequency level L2 of execution of the second stabilization process.

Next, CPU 611 reads a value of the execution frequency of the second stabilization process, which is counted since the processing for changing the frequency level of execution of the preceding stabilization process is carried out, from counter CTSTABI2 stored in nonvolatile memory 615, and compares the counted value with threshold value A, that is, "88", "40" or "22" (step S1313). When the counted value is less than threshold value A (NO in step S1313), CPU 611 carries out the processing for lowering the frequency level of execution of the first stabilization process (step S1315). When the counted value is not less than threshold value A (YES in step S1313), CPU 611 carries out the processing for lowering the frequency level of execution of the second stabilization process (step S1317). That is, when the execution frequency of the second stabilization process is not less than the predetermined frequency irrespective of frequency level L2 of execution of the second stabilization process, CPU 611 determines that the second stabilization process is carried out excessively and the execution frequency of the second stabilization process is larger than that of the first stabilization process, and carries out the processing for lowering the frequency level of execution of the second stabilization process.

On the other hand, when the execution frequency of the second stabilization process is smaller than the predetermined frequency irrespective of frequency level L2 of execution of the second stabilization process, CPU 611 determines that the second stabilization process is not executed so much and the execution frequency of the first stabilization process is larger than that of the second stabilization process, and carries out the processing for lowering the frequency level of execution of the first stabilization process.

Specifically, the processing for changing the frequency level of execution of the first or second stabilization process in steps S1115, S1117, S1201, S1203, S1315 and S1317 is carried out by changing the threshold value used for determining whether to execute the stabilization process. That is, when the threshold value is decreased, an opportunity to determine that the stabilization process is executed is increased. Thus, the execution frequency of the stabilization process is increased. On the other hand, when the threshold value is increased, the opportunity to determine that the stabilization process is executed is decreased. Thus, the execution frequency of the stabilization process is decreased.

As shown in FIG. 6, the determination whether to execute the first stabilization process, that is, the stabilization process after execution of the warm-up process in turn-on or return is made in accordance with environment value T such as an in-apparatus temperature at this time. In order to change the frequency level of execution of the first stabilization process, therefore, threshold value ΔT1 of the environment value is changed. When threshold value ΔT1 of the environment value is decreased, the first stabilization process is executed in a state that change in in-apparatus temperature is smaller. Thus, the execution frequency of the first stabilization process is increased. On the other hand, when threshold value ΔT1 of the environment value is increased, the first stabilization process is not executed until the change in in-apparatus temperature reaches a predetermined amount. Therefore, the execution frequency of the first stabilization process is decreased.

As shown in FIG. 9, the determination whether to execute the second stabilization process, that is, the stabilization process executed automatically in the printing process is made in accordance with count of sheets of paper CTPRINT2, which is kept since the preceding stabilization process is executed, in addition to environment value T such as an in-apparatus temperature at this time. In order to change the frequency level of execution of the second stabilization process, therefore, threshold value ΔT2 of the environment value and threshold value CT2 of the count of printed sheets of paper are changed. When threshold value ΔT2 of the environment value and threshold value CT2 of the count of printed sheets of paper are decreased, the second stabilization process is executed in a state that change in in-apparatus temperature is smaller or the count of printed sheets of paper is smaller. Thus, the execution frequency of the second stabilization process is increased. On the other hand, when threshold value ΔT2 of the environment value and threshold value CT2 of the count of printed sheets of paper are increased, the second stabilization process is not executed until the change in in-apparatus temperature reaches a predetermined amount or the count of printed sheets of paper reaches a larger count. Therefore, the execution frequency of the second stabilization process is decreased.

A specific example of a flow of the processing for raising the frequency level of execution of the first stabilization process in step S1115 will be explained as follows by using FIG. 18. A specific example of a flow of the processing for lowering the frequency level of the first stabilization process in step S1201 or S1315 will be explained as follows by using FIG. 19. A specific example of a flow of the processing for raising the frequency level of execution of the second stabilization process in step S1117 will be explained as follows by using FIG. 20. A specific example of a flow of the processing for lowering the frequency level of execution of the second stabilization process in step S1203 or S1317 will be explained as follows by using FIG. 21.

Figure 18:
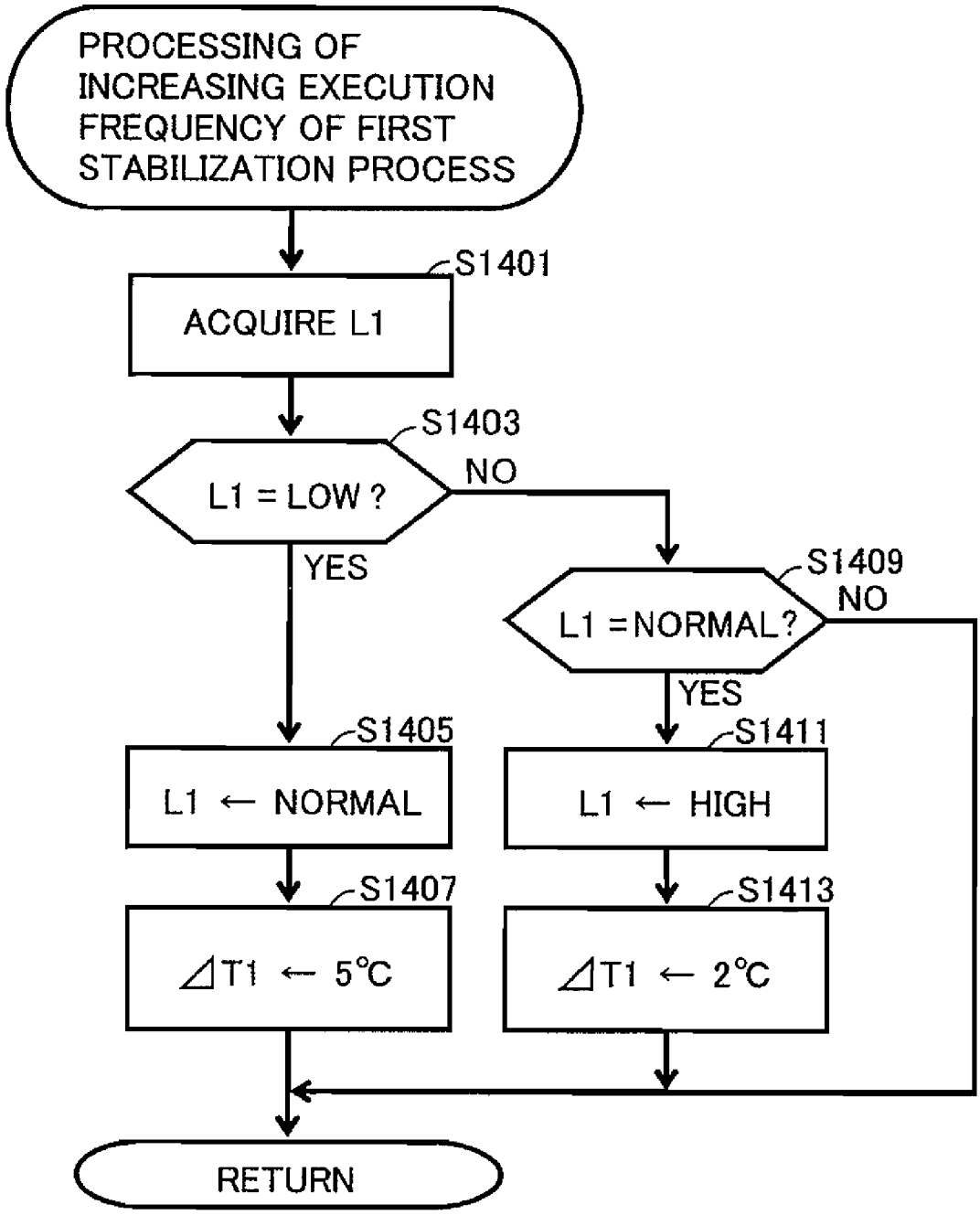
FIG. 18 is a flowchart showing a specific example of a flow of processing for raising the frequency level of execution of the first stabilization process.

With reference to FIG. 18, in order to raise the frequency level of execution of the first stabilization process, first, CPU 611 reads frequency level L1 of execution of the first stabilization process from nonvolatile memory 615 (step S1401). When frequency level L1 is set at "low" (YES in step S1403), CPU 611 changes frequency level L1 to "normal" which is higher in level than "low" by one rank (step S1405). Next, CPU 611 sets threshold value ΔT1 of the environment value used for determining whether to execute the first stabilization process, at the value which is stored previously in ROM 612 or the like while being correlated with the level "normal", specifically, 5° C. which is smaller than the current threshold value (for example, 8° C.) (step S1407).

When frequency level L1 is set at "normal" (NO in step S1403 and YES in step S1409), CPU 611 changes frequency level L1 to "high" which is higher in level than "normal" by one rank (step S1411). Next, CPU 611 sets threshold value ΔT1 at the value which is stored previously in ROM 612 or the like while being correlated with the level "high", specifically, 2° C. which is smaller than the current threshold value (for example, 5° C.) (step S1413). When frequency level L1 is set at "high" (NO in step S1403 and NO in step S1409), there is no level higher than the current level. Therefore, CPU 611 completes the processing without carrying out the processing for raising the frequency level.

According to this processing, if there is a level higher than a level which is set currently as the frequency level of execution of the first stabilization process, the frequency level is set at the level which is higher by one rank. Further, threshold value ΔT1 of the environment value for determining whether to execute the first stabilization process is decreased. Thus, the frequency level of execution of the first stabilization process is raised.

Figure 19:
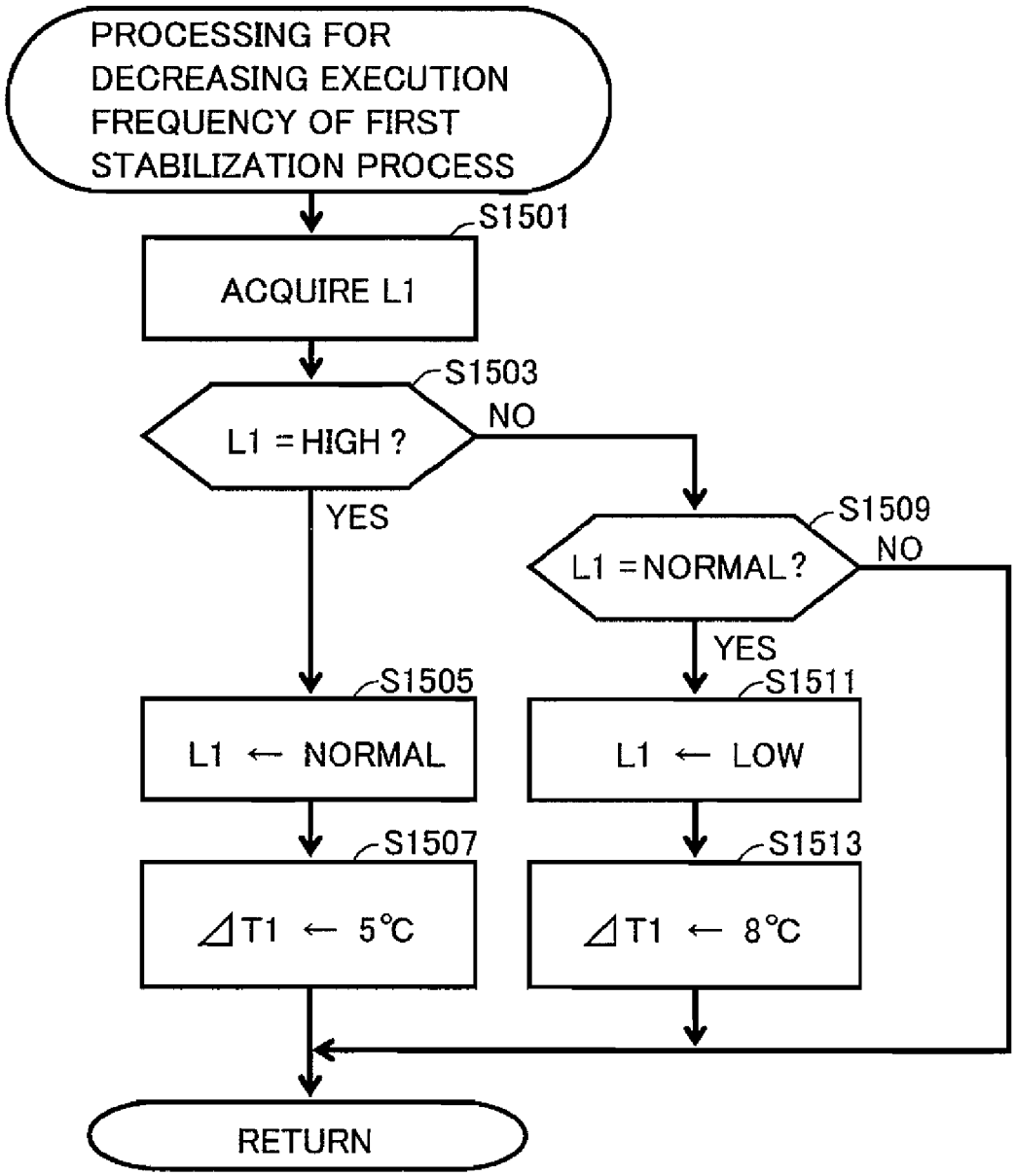
FIG. 19 is a flowchart showing a specific example of a flow of processing for lowering the frequency level of execution of the first stabilization process.

With reference to FIG. 19, in order to decrease the execution frequency of the first stabilization process, CPU 611 reads frequency level L1 of execution of the first stabilization process from nonvolatile memory 615 (step S1501). When frequency level L1 is set at "high" (YES in step S1503), CPU 611 changes frequency level L1 to "normal" which is lower in level than "high" by one rank (step S1505). Next, CPU 611 sets threshold value ΔT1 of the environment value which is used for determining whether to execute the first stabilization process, at the value which is stored previously in ROM 612 or the like while being correlated with the level "normal", specifically, 5° C. which is larger than the current threshold value (for example, 2° C.) (step S1507).

When frequency level L1 is set at "normal" (NO in step S1503 and YES in step S1509), CPU 611 changes frequency level L1 to "low" which is lower in level than "normal" by one rank (step S1511). Next, CPU 611 sets threshold value ΔT1 at the value which is stored previously in ROM 612 or the like while being correlated with the level "low", specifically, 8° C. which is larger than the current threshold value (for example, 5° C.) (step S1513). When frequency level L1 is set at "low" (NO in step S1503 and NO in step S1509), there is no level lower than the current level. Therefore, CPU 611 completes the processing without carrying out the processing for lowering the frequency level.

According to this processing, if there is a level lower than a level which is set currently as the frequency level of execution of the first stabilization process, the frequency level is set at the level which is lower by one rank. Further, threshold value ΔT1 of the environment value for determining whether to execute the first stabilization process is increased. Thus, the frequency level of execution of the first stabilization process is lowered.

Figure 20:
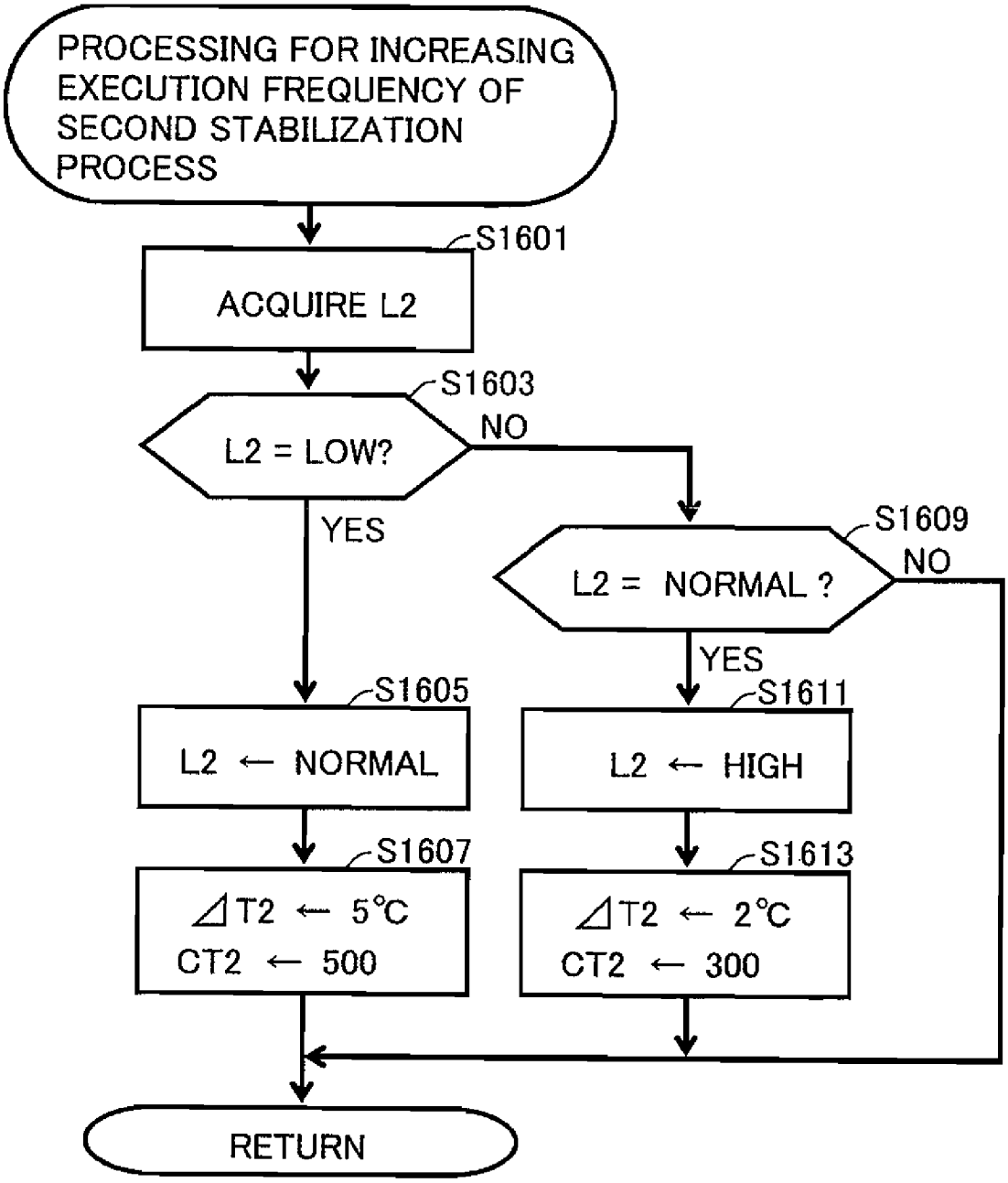
FIG. 20 is a flowchart showing a specific example of a flow of processing for raising the frequency level of execution of the second stabilization process.

With reference to FIG. 20, in order to raise the frequency level of execution of the second stabilization process, first, CPU 611 reads frequency level L2 of execution of the second stabilization process from nonvolatile memory 615 (step S1601). When frequency level L2 is set at "low" (YES in step S1603), CPU 611 changes frequency level L2 to "normal" which is higher in level than "low" by one rank (step S1605). Next, CPU 611 sets threshold value ΔT2 of the environment value used for determining whether to execute the second stabilization process, at the value which is stored previously in ROM 612 or the like while being correlated with the level "normal", specifically, 5° C. which is smaller than the current threshold value (for example, 8° C.) (step S1607). In step S1607, further, CPU 611 sets threshold value CT2 of the count of printed sheets of paper, which is used for determining whether to execute the second stabilization process, at the value which is stored previously in ROM 612 or the like while being correlated with the level "normal", specifically, 500 which is smaller than the current threshold value (for example, 800).

When frequency level L2 is set at "normal" (NO in step S1603 and YES in step S1609), CPU 611 changes frequency level L2 to "high" which is higher in level than "normal" by one rank (step S1611). Next, CPU 611 sets threshold value ΔT2 at the value which is stored previously in ROM 612 or the like while being correlated with the level "high", specifically, 2° C. which is smaller than the current threshold value (for example, 5° C.) (step S1613). In step S1613, further, CPU 611 sets threshold value CT2 at the value which is stored previously in ROM 612 or the like while being correlated with the level "high", specifically, 300 which is smaller than the current threshold value (for example, 500). When frequency level L2 is set at "high" (NO in step S1603 and NO in step S1609), there is no level higher than the current level. Therefore, CPU 611 completes the processing without carrying out the processing for raising the frequency level.

According to this processing, if there is a level higher than a level which is set currently as the frequency level of execution of the second stabilization process, the frequency level is set at the level which is higher by one rank. Further, threshold value ΔT2 of the environment value and threshold value CT2 of the count of printed sheets of paper, each of which is used for determining whether to execute the second stabilization process, are decreased. Thus, the frequency level of execution of the second stabilization process is raised.

Figure 21:
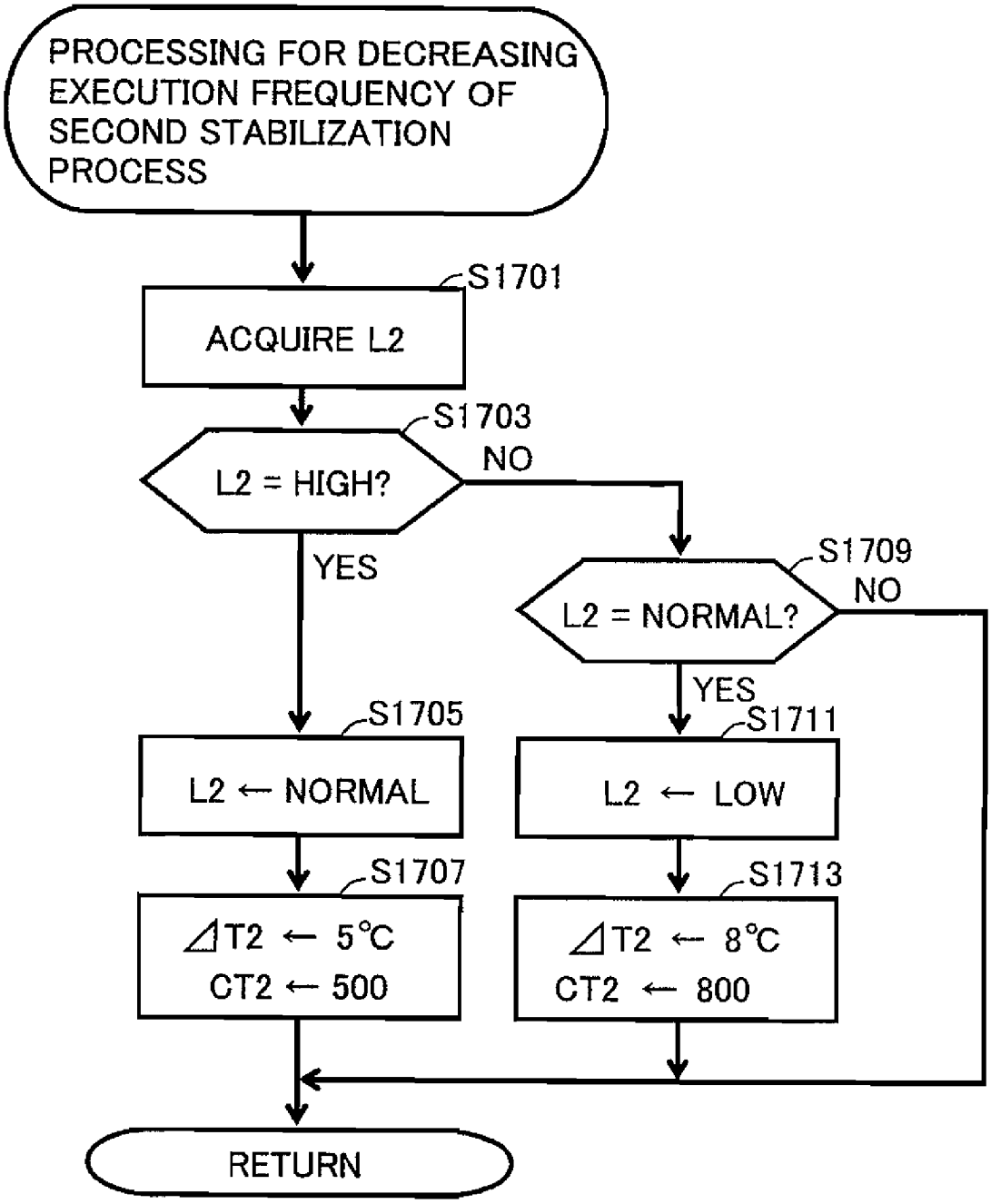
FIG. 21 is a flowchart showing a specific example of a flow of processing for lowering the frequency level of execution of the second stabilization process.

With reference to FIG. 21, in order to decrease the execution frequency of the second stabilization process, CPU 611 reads frequency level L2 of execution of the second stabilization process from nonvolatile memory 615 (step S1701). When frequency level L2 is set at "high" (YES in step S1703), CPU 611 changes frequency level L2 to "normal" which is lower in level than "high" by one rank (step S1705). Next, CPU 611 sets threshold value ΔT2 of the environment value which is used for determining whether to execute the second stabilization process, at the value which is stored previously in ROM 612 or the like while being correlated with the level "normal", specifically, 5° C. which is larger than the current threshold value (for example, 2° C.) (step S1707). In step S1707, further, CPU 611 sets threshold value CT2 of the count of printed sheets of paper, which is used for determining whether to execute the second stabilization process, at the value which is stored previously in ROM 612 or the like while being correlated with the level "normal", specifically, 500 which is larger than the current threshold value (for example, 300).

When frequency level L2 is set at "normal" (NO in step S1703 and YES in step S1709), CPU 611 changes frequency level L2 to "low" which is lower in level than "normal" by one rank (step S1711). Next, CPU 611 sets threshold value ΔT2 at the value which is stored previously in ROM 612 or the like while being correlated with the level "low", specifically, 8° C. which is larger than the current threshold value (for example, 5° C.) (step S1713). In step S1713, further, CPU 611 sets threshold value CT2 at the value which is stored previously in ROM 612 or the like while being correlated with the level "low", specifically, 800 which is larger than the current threshold value (for example, 500). When frequency level L2 is set at "low" (NO in step S1703 and NO in step S1709), there is no level lower than the current level. Therefore, CPU 611 completes the processing without carrying out the processing for lowering the frequency level.

According to this processing, if there is a level lower than a level which is set currently as the frequency level of execution of the second stabilization process, the frequency level is set at the level which is lower by one rank. Further, threshold value ΔT2 of the environment value and threshold value CT2 of the count of printed sheets of paper, each of which is used for determining whether to execute the second stabilization process, are increased. Thus, the frequency level of execution of the second stabilization process is lowered.

In the following description, the parameter of threshold value ΔT2 of the environment value and the parameter of threshold value CT2 of the count of printed sheets of paper are changed in order to change the frequency level of execution of the second stabilization process. The advantage upon change in frequency level is also attained even in a case of changing only one of the two threshold values. Preferably, the two parameters are changed. However, only the threshold value of at least one of the two parameters may be changed.

Figure 23:
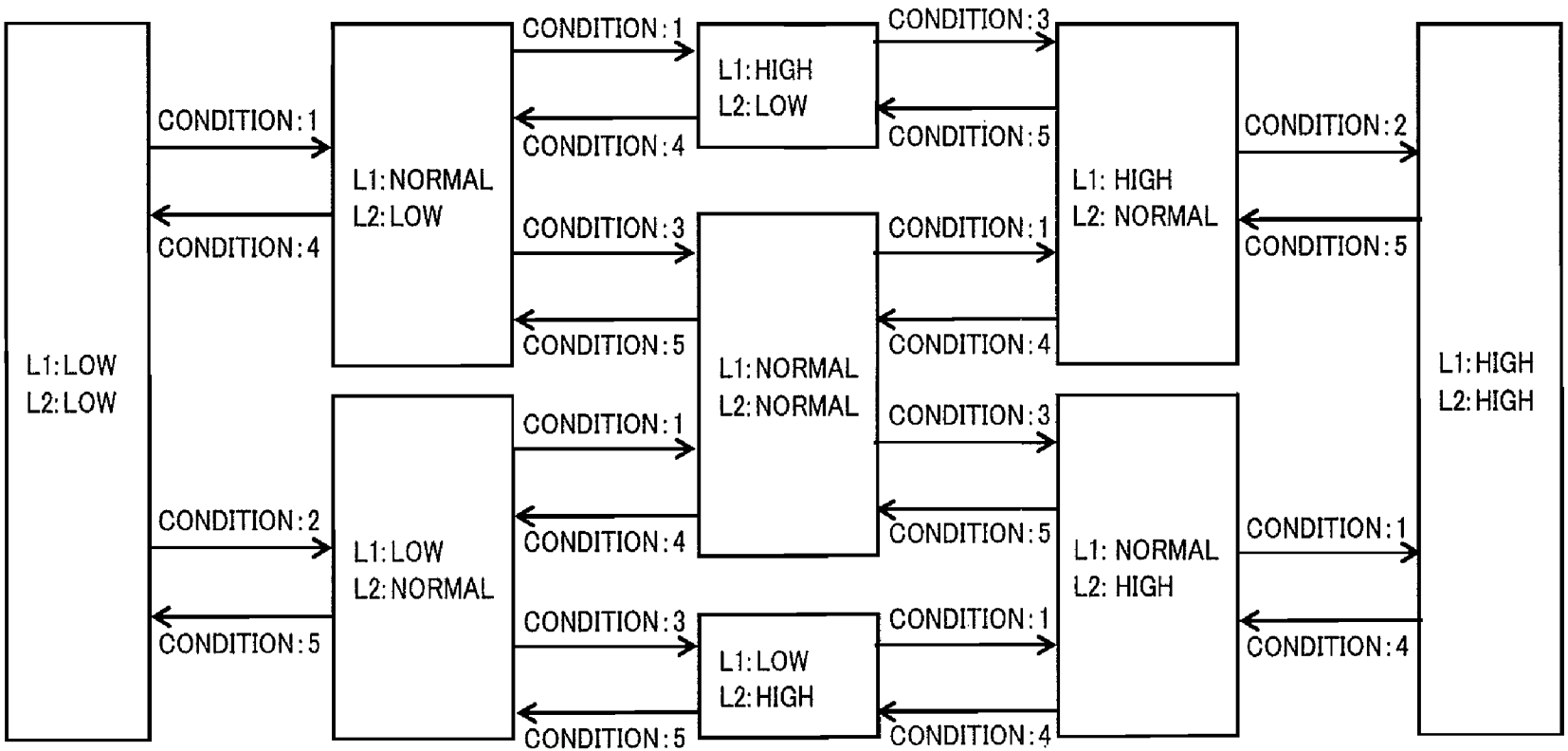
FIG. 23 shows transition of the frequency level of execution of the stabilization process.

A result of the foregoing processing, that is, transition of the frequency level of execution of the stabilization process in MFP 1 comes to be shown in FIGS. 22 and 23. With reference to FIG. 22, Conditions 1 to 5 denote conditions for changing the frequency level of execution of the stabilization process, respectively. As described above, the most significant condition for changing the frequency level of execution of the stabilization process is the execution frequency of the third stabilization process which is the stabilization process executed based on the user's instruction. When the execution frequency of the third stabilization process is large, it is determined that the user has a complaint regarding image quality. Thus, the frequency level of execution of the stabilization process is raised. On the other hand, when the execution frequency of the third stabilization process is small, it is determined that image quality obtained herein exceeds that desired by the user. Thus, the frequency level of execution of the stabilization process is lowered.

More specifically, even in a case where the execution frequency of the third stabilization process is large, when the frequency of warm-up process executed after turn-on or return from the sleep state (frequency of return) is large while the execution frequency of the first stabilization process is small, engine controller 61 determines that the frequency level of execution of the first stabilization process rather than the second stabilization process is raised so that the execution frequency of the entire stabilization processes is increased effectively, and raises the frequency level of execution of the first stabilization process. This condition is defined as "Condition 1".

When the execution frequency of the first stabilization process is large although the frequency of return is large, engine controller 61 determines that the frequency level of execution of the second stabilization process rather than the first stabilization process is raised so that the execution frequency of the entire stabilization processes is increased effectively, and raises the frequency level of execution of the second stabilization process. This condition is defined as "Condition 2".

When the frequency of return is small, likewise, engine controller 61 determines that the frequency level of execution of the second stabilization process rather than the first stabilization process is raised so that the execution frequency of the entire stabilization processes is increased effectively, and raises the frequency level of execution of the second stabilization process. This condition is defined as "Condition 3".

When the execution frequency of the third stabilization process is small and the execution frequency of the first stabilization process is large, engine controller 61 determines that the frequency level of execution of the first stabilization process rather than the second stabilization process is lowered so that the execution frequency of the entire stabilization processes is decreased effectively, and lowers the frequency level of execution of the first stabilization process. This condition is defined as "Condition 4".

When the execution frequency of the first stabilization process is small, engine controller 61 determines that the frequency level of execution of the second stabilization process rather than the first stabilization process is lowered so that the execution frequency of the entire stabilization processes is decreased effectively, and lowers the frequency level of execution of the second stabilization process. This condition is defined as "Condition 5".

Using the conditions described above, engine controller 61 of MFP 1 changes the frequency level of execution of the first stabilization process and the frequency level of execution of the second stabilization process as shown in FIG. 23. With reference to FIG. 23, in a state that the frequency level of execution of the first stabilization process is "low" and the frequency level of execution of the second stabilization process is "low" (L1: Low, L2: Low), when "Condition 1" is detected, engine controller 61 raises the frequency level of execution of the first stabilization process to set a state that the frequency level of execution of the first stabilization process is "normal" and the frequency level of execution of the second stabilization process is "low" (L1: Normal, L2: Low). In this state, when "Condition 1" is detected, engine controller 61 raises the frequency level of execution of the first stabilization process to set a state that the frequency level of execution of the first stabilization process is "high" and the frequency level of execution of the second stabilization process is "low" (L1: High, L2: Low). In this state, when "Condition 4" is detected, engine controller 61 lowers the frequency level of execution of the first stabilization process to set the state that the frequency level of execution of the first stabilization process is "normal" and the frequency level of execution of the second stabilization process is "low" (L1: Normal, L2: Low). In this state, when "Condition 4" is detected, engine controller 61 lowers the frequency level of execution of the first stabilization process to set a state that the frequency level of execution of the first stabilization process is "low" and the frequency level of execution of the second stabilization process is "low" (L1: Low, L2: Low).

In the state that the frequency level of execution of the first stabilization process is "low" and the frequency level of execution of the second stabilization process is "low" (L1: Low, L2: Low), when "Condition 2" is detected, engine controller 61 raises the frequency level of execution of the second stabilization process to set a state that the frequency level of execution of the first stabilization process is "low" and the frequency level of execution of the second stabilization process is "normal" (L1: Low, L2: Normal). In this state, when "Condition 3" is detected, engine controller 61 raises the frequency level of execution of the second stabilization process to set a state that the frequency level of execution of the first stabilization process is "low" and the frequency level of execution of the second stabilization process is "high" (L1: Low, L2: High). In this state, when "Condition 5" is detected, engine controller 61 lowers the frequency level of execution of the second stabilization process to set the state that the frequency level of execution of the first stabilization process is "low" and the frequency level of execution of the second stabilization process is "normal" (L1: Low, L2: Normal). In this state, when "Condition 5" is detected, engine controller 61 lowers the frequency level of execution of the second stabilization process to set the state that the frequency level of execution of the first stabilization process is "low" and the frequency level of execution of the second stabilization process is "low" (L1: Low, L2: Low).

In the state that the frequency level of execution of the first stabilization process is "normal" and the frequency level of execution of the second stabilization process is "low" (L1: Normal, L": Low), when "Condition 3" is detected, engine controller 61 raises the frequency level of execution of the second stabilization process to set a state that frequency level of execution of the first stabilization process is "normal" and the frequency level of execution of the second stabilization process is "normal" (L1: Normal, L2: Normal). In the state that the frequency level of execution of the first stabilization process is "low" and the frequency level of execution of the second stabilization process is "normal" (L1: Low, L2: Normal), when "Condition 1" is detected, engine controller 61 raises the frequency level of execution of the first stabilization process to set the state that the frequency level of execution of the first stabilization process is "normal" and the frequency level of execution of the second stabilization process is "normal" (L1: Normal, L2: Normal). In this state, when "Condition 1" is detected, engine controller 61 raises the frequency level of execution of the first stabilization process to set a state that the frequency level of execution of the first stabilization process is "high" and the frequency level of execution of the second stabilization process is "normal" (L1: High, L2: Normal). When "Condition 3" is detected, engine controller 61 raises the frequency level of execution of the second stabilization process to set a state that the frequency level of execution of the first stabilization process is "normal" and the frequency level of execution of the second stabilization process is "high" (L1: Normal, L2: High). In the state that the frequency level of execution of the first stabilization process is "high" and the frequency level of execution of the second stabilization process is "low" (L1: High, L2: Low), when "Condition 3" is detected, engine controller 61 raises the frequency level of execution of the second stabilization process to set the state that the frequency level of execution of the first stabilization process is "high" and the frequency level of execution of the second stabilization process is "normal" (L1: High, L2: Normal). In the state that the frequency level of execution of the first stabilization process is "low" and the frequency level of execution of the second stabilization process is "high" (L1: Low, L2: High), when "Condition 1" is detected, engine controller 61 raises the frequency level of execution of the first stabilization process to set the state that the frequency level of execution of the first stabilization process is "normal" and the frequency level of execution of the second stabilization process is "high" (L1: Normal, L2: High).

In the state that the frequency level of execution of the first stabilization process is "high" and the frequency level of execution of the second stabilization process is "normal" (L1: High, L2: Normal), when "Condition 5" is detected, engine controller 61 lowers the frequency level of execution of the second stabilization process to set the state that the frequency level of execution of the first stabilization process is "high" and the frequency level of execution of the second stabilization process is "low" (L1: High, L2: Low). When "Condition 2" is detected, engine controller 61 raises the frequency level of execution of the second stabilization process to set a state that the frequency level of execution of the first stabilization process is "high" and the frequency level of execution of the second stabilization process is "high" (L1: High, L2: High). When "Condition 4" is detected, engine controller 61 lowers the frequency level of execution of the first stabilization process to set the state that the frequency level of execution of the first stabilization process is "normal" and the frequency level of execution of the second stabilization process is "normal" (L1: Normal, L2: Normal). In this state, when "Condition 5" is detected, engine controller 61 lowers the frequency level of execution of the second stabilization process to set the state that the frequency level of execution of the first stabilization process is "normal" and the frequency level of execution of the second stabilization process is "low" (L1: Normal, L2: Low).

In the state that the frequency level of execution of the first stabilization process is "normal" and the frequency level of execution of the second stabilization process is "high" (L1: Normal, L2: High), when "Condition 4" is detected, engine controller 61 lowers the frequency level of execution of the first stabilization process to set the state that the frequency level of execution of the first stabilization process is "low" and the frequency level of execution of the second stabilization process is "high" (L1: Low, L2: High). When "Condition 1" is detected, engine controller 61 raises the frequency level of execution of the first stabilization process to set the state that the frequency level of execution of the first stabilization process is "high" and the frequency level of execution of the second stabilization process is "high" (L1: High, L2: High). When "Condition 5" is detected, engine controller 61 lowers the frequency level of execution of the second stabilization process to set the state that the frequency level of execution of the first stabilization process is "normal" and the frequency level of execution of the second stabilization process is "normal" (L1: Normal, L2: Normal). In this state, when "Condition 4" is detected, engine controller 61 lowers the frequency level of execution of the first stabilization process to set the state that the frequency level of execution of the first stabilization process is "low" and the frequency level of execution of the second stabilization process is "normal" (L1: Low, L2: Normal).

In the state that the frequency level of execution of the first stabilization process is "high" and the frequency level of execution of the second stabilization process is "high" (L1: High, L2: High), when "Condition 5" is detected, engine controller 61 lowers the frequency level of execution of the second stabilization process to set the state that the frequency level of execution of the first stabilization process is "high" and the frequency level of execution of the second stabilization process is "normal" (L1: High, L2: Normal). When "Condition 4" is detected, engine controller 61 lowers the frequency level of execution of the first stabilization process to set the state that the frequency level of execution of the first stabilization process is "normal" and the frequency level of execution of the second stabilization process is "high" (L1: Normal, L2: High).

As described above, MFP 1 changes the execution frequency of the stabilization process to optimize the execution frequency of the stabilization process while offering the satisfying image quality to the user. Upon execution of the stabilization process with the image formation process being interrupted, thus, MFP 1 prevents the following disadvantages. That is, the user waits for restart of the image formation process, and consumables are consumed excessively due to excessive execution of the stabilization process. Using the plurality of conditions, moreover, MFP 1 selects the stabilization process for changing the frequency level from the plurality of stabilization processes executed automatically. Thus, MFP 1 can effectively change the execution frequency of the entire stabilization processes.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

an image forming part for forming an image on a printing medium based on image data;

a stabilization processing part for executing a stabilization process for stabilizing image formation carried out by said image forming part, said stabilization process including a first stabilization process and a second stabilization process;

an instruction part for accepting, from a user, an instruction to execute said stabilization process;

a controller for controlling said stabilization process;

a first counter for counting an execution frequency of said second stabilization process; and a setting part for setting a frequency level of execution of said first stabilization process, wherein said controller controls said stabilization processing part and said setting part to (i) make first determination whether to execute said stabilization process and execute said first stabilization process at a timing based on the first determination;

(ii) execute said second stabilization process at a timing based on said instruction accepted by said instruction part; and (iii) change the frequency level of execution of said first stabilization process, based on the execution frequency of said second stabilization process.

2. The image forming apparatus according to claim 1, wherein said controller carries out the processing for changing the frequency level of execution of said first stabilization process to raise the frequency level of execution of said first stabilization process when the execution frequency of said second stabilization process is larger than a threshold value and to lower the frequency level of execution of said first stabilization process when the execution frequency of said second stabilization process is smaller than said threshold value.

3. The image forming apparatus according to claim 1, wherein said first stabilization process includes a third stabilization process and a fourth stabilization process which are executed at different timings, said setting part sets a frequency level of execution of said third stabilization process and a frequency level of execution of said fourth stabilization process, said controller makes second determination for determining an execution frequency of one of said third stabilization process and said fourth stabilization process, and said controller carries out the processing for changing the frequency level of execution of said first stabilization process to change the frequency level of execution of said third stabilization process and/or the frequency level of execution of said fourth stabilization process, based on the execution frequency of said second stabilization process and the execution frequency of one of said third stabilization process and said fourth stabilization process.

4. The image forming apparatus according to claim 3, wherein in a case of carrying out the processing for changing the frequency level of execution of said first stabilization process to raise the frequency level of execution of said first stabilization process, when it is determined that the execution frequency of one of said third stabilization process and said fourth stabilization process is large, said controller raises the frequency level of execution of the other one of said third stabilization process and said fourth stabilization process.

5. The image forming apparatus according to claim 3, wherein in a case of carrying out the processing for changing the frequency level of execution of said first stabilization process to raise the frequency level of execution of said first stabilization process, when it is determined that the execution frequency of one of said third stabilization process and said fourth stabilization process is small, said controller raises the frequency level of execution of the relevant said one of said third stabilization process and said fourth stabilization process.

6. The image forming apparatus according to claim 3, wherein in a case of carrying out the processing for changing the frequency level of execution of said first stabilization process to lower the frequency level of execution of said first stabilization process, when it is determined that the execution frequency of one of said third stabilization process and said fourth stabilization process is large, said controller lowers the frequency level of execution of the relevant said one of said third stabilization process and said fourth stabilization process.

7. The image forming apparatus according to claim 3, wherein in a case of carrying out the processing for changing the frequency level of execution of said first stabilization process to lower the frequency level of execution of said first stabilization process, when it is determined that the execution frequency of one of said third stabilization process and said fourth stabilization process is small, said controller lowers the frequency level of execution of the other one of said third stabilization process and said fourth stabilization process.

8. The image forming apparatus according to claim 3, wherein said third stabilization process is executed at a timing based on said first determination to execute said third stabilization process in a timing related to a warm-up process which is executed in turn-on of the image forming apparatus or in return from a sleep state in the image forming apparatus, and said fourth stabilization process is executed at a timing based on said first determination to execute said fourth stabilization process in said image formation.

9. The image forming apparatus according to claim 8, further comprising a second counter for counting a frequency of return of the image forming apparatus, wherein in a case of carrying out the processing for changing the frequency level of execution of said first stabilization process to raise the frequency level of execution of said first stabilization process, said controller changes the frequency level of execution of one of said third stabilization process and said fourth stabilization process based on the execution frequency of one of said third stabilization process and said fourth stabilization process when said frequency of return is larger than a threshold value and raises the frequency level of execution of said fourth stabilization process when said frequency of return is smaller than said threshold value.

10. The image forming apparatus according to claim 3, wherein said second determination is made to determine the execution frequency of one of said third stabilization process and said fourth stabilization process, based on the setting frequency level of execution of said one of said third stabilization process and said fourth stabilization process and the execution frequency of the relevant said one of said third stabilization frequency and said fourth stabilization frequency.

11. The image forming apparatus according to claim 1, wherein said controller carries out the processing for changing the frequency level of execution of said first stabilization process, changes a value of a parameter for use in said first determination, to change said frequency level.

* * * * *